US009795168B2

(12) United States Patent
Zhu

(10) Patent No.: US 9,795,168 B2
(45) Date of Patent: Oct. 24, 2017

(54) HEATING ASSEMBLIES FOR E-CIGARETTE VAPORIZERS

(71) Applicant: Xiaochun Zhu, Guangdong (CN)

(72) Inventor: Xiaochun Zhu, Guangdong (CN)

( * ) Notice: Subject to any disclaimer, the term of this patent is extended or adjusted under 35 U.S.C. 154(b) by 533 days.

(21) Appl. No.: 14/573,925

(22) Filed: Dec. 17, 2014

(65) Prior Publication Data

US 2016/0106153 A1 Apr. 21, 2016

Related U.S. Application Data

(63) Continuation of application No. PCT/CN2014/090827, filed on Nov. 11, 2014.

(30) Foreign Application Priority Data

Oct. 21, 2014 (CN) ..... 2014 1 05640381

(51) Int. Cl.
*A24F 47/00* (2006.01)
*F22B 1/28* (2006.01)
(Continued)

(52) U.S. Cl.
CPC ..... *A24F 47/008* (2013.01); *F22B 1/284* (2013.01); *H05B 1/0297* (2013.01); *H05B 3/44* (2013.01)

(58) Field of Classification Search
None
See application file for complete search history.

(56) References Cited

U.S. PATENT DOCUMENTS

2014/0217085 A1 8/2014 Alima
2017/0150755 A1* 6/2017 Batista ..... A24F 47/008

FOREIGN PATENT DOCUMENTS

CN 203676127 U 7/2014
CN 104068476 A 10/2014
(Continued)

OTHER PUBLICATIONS

International Search Report of International Application No. PCT/CN2014/090827, Jul. 29, 2015.

*Primary Examiner* — Michael J Felton
*Assistant Examiner* — Katherine Will
(74) *Attorney, Agent, or Firm* — Locke Lord LLP; Tim Tingkang Xia, Esq.

(57) ABSTRACT

The present invention relates to vaporizer heating assemblies for electronic cigarettes. In certain embodiments, vaporizer heating assemblies include: heating assembly and electric conductor assembly. Heating assembly includes: heating assembly covers, round heating element mounting base, heating elements, and e-liquid media. Heating elements have heating wires formed in a large surface to ensure sufficient vaporization of e-liquid. Heating assembly covers define certain e-liquid conduit openings to allow the e-liquid to flow from outside of the heating assembly covers into the e-liquid media. The heating elements are in direct contact with the e-liquid media to generate large amount of vapor for its user. Electric conductor assembly includes: an electric connector base for a first terminal of heating elements, an electrode for a second terminal of heating elements, and an insulation cover to insulate the electric connector base and the electrode. Electric conductor assembly is positioned in a lower portion of heating assembly.

20 Claims, 17 Drawing Sheets

(51) Int. Cl.
*H05B 1/02* (2006.01)
*H05B 3/44* (2006.01)

(56) References Cited

FOREIGN PATENT DOCUMENTS

| | | | |
|---|---|---|---|
| CN | 104287098 | A | 1/2015 |
| CN | 204191592 | U | 3/2015 |
| EP | 2574247 | A1 | 4/2013 |

* cited by examiner

HEATING ASSEMBLIES FOR E-CIGARETTE VAPORIZERS

CROSS-REFERENCE TO RELATED APPLICATIONS

This application is a continuation application of a PCT Application No. PCT/CN2014/090827, filed with the State Intellectual Property Office of China on Nov. 11, 2014, entitled "Heating assemblies for e-cigarette vaporizers", by Xiaochun ZHU, which itself claims the priority to Chinese Patent Application No. 201410564038.1, filed with the State Intellectual Property Office of China on Oct. 21, 2014, entitled "Heating assemblies for e-cigarette vaporizers," by Xiaochun ZHU, the disclosures of which are incorporated herein in their entireties by reference.

Some references, if any, which may include patents, patent applications and various publications, may be cited and discussed in the description of this invention. The citation and/or discussion of such references, if any, is provided merely to clarify the description of the present invention and is not an admission that any such reference is "prior art" to the invention described herein. All references listed, cited and/or discussed in this specification are incorporated herein by reference in their entireties and to the same extent as if each reference was individually incorporated by reference.

FIELD

The present invention generally relates to the field of electronic cigarette (or e-cigarette), and more particularly to heating assemblies of electronic cigarette vaporizer.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

It is well known that smoking cigarette is harmful to smoker's health. The active ingredient in a cigarette is mainly nicotine. During smoking, nicotine, along with tar aerosol droplets produced in the cigarette burning, are breathed into the alveolus and absorbed quickly by the smoker. Once nicotine is absorbed into the blood of the smoker, nicotine then produces its effect on the receptors of the smoker's central nervous system, causing the smoker relax and enjoy an inebriety similar to that produced by an exhilarant.

The electronic cigarette is sometimes referred as electronic vaporing device, personal vaporizer (PV), or electronic nicotine delivery system (ENDS). It is a battery-powered device which simulates tobacco smoking. It generally uses a heating element that vaporizes a liquid solution (e-liquid). Some solutions contain a mixture of nicotine and a variety of flavorings, while others release a flavored vapor without nicotine. Many are designed to simulate smoking experience, such as cigarette smoking or cigar smoking. Some of them are made with similar appearance, while others are made considerably different in appearance.

Conventional electronic cigarettes are made with a mouth piece assembly, a vaporizer assembly, an electric connecting assembly, and an e-liquid storage assembly. The mouth piece is installed on top of the e-liquid storage assembly, and the vaporizer assembly is installed inside of the e-liquid storage assembly, and electrically connected to a DC power source through the electric connecting assembly. The mouth piece assembly is connected to the vaporizer assembly and forms an air flow passage. The e-liquid is stored in the e-liquid storage assembly. The e-liquid flows through a vaporizing chamber of the heating assembly using fiber threads. The e-liquid in the fiber threads is then heated by a heating wire of the heating assembly and therefore vaporized. The vaporized e-liquid goes up to the mouth piece such that a smoker enjoys the vaporized e-liquid. However, the vapor flow and the quantity and speed of e-liquid vaporization are not controllable or adjustable to meet the different demands of various electronic cigarette smokers.

Therefore, heretofore unaddressed needs exist in the art to address the aforementioned deficiencies and inadequacies.

SUMMARY

In one aspect, the present invention relates to a first vaporizer heating assembly for electronic cigarettes. In certain embodiments, the first vaporizer heating assembly includes: (a) a cylindrical heating assembly base, (b) a circular heating element mounting base, (c) one or more heating elements, (d) certain e-liquid media, and (e) certain e-liquid medium arches.

In certain embodiments, the cylindrical heating assembly base is positioned on a circular heating element base. The cylindrical heating assembly base has an open upper end defining a mounting hole, and an opposite, open lower end. Two e-liquid conduit openings are defined on a first side of middle section of the cylindrical heating assembly base, and an opposite, second side of the middle section of the cylindrical heating assembly base.

The circular heating element mounting base is detachably positioned inside of the cylindrical heating assembly base. The circular heating element mounting base has two upright arches with two upright separator plates connecting the two upright arches and defines a mounting base air vent inside of the two separator plates. Two mounting portions are positioned outside of the two separator plates. Each of the two separator plates defines a heating element opening.

Each of the one or more heating elements is positioned inside the heating element opening of each of the separator plates, respectively. Each of the heating elements comprises a first terminal, and a second terminal. Each of the e-liquid media is detachably positioned outside of each of the heating elements in each of the mounting portions, respectively. Each of the e-liquid medium arches is detachably positioned outside each of the plurality of e-liquid media, respectively. Each of the e-liquid medium arches defines an e-liquid opening in communication with the e-liquid conduit opening to allow e-liquid to flow through the e-liquid conduit opening to reach the e-liquid media.

In certain embodiments, the first vaporizer heating assembly also has: (a) an electric connector base, (b) an electrode, (c) an insulation cover, and (d) a sealing ring. The electric connector base is attached to the open lower end of the cylindrical heating assembly base and adapted for connecting an electric power supply to the first vaporizer heating assembly. The electric connector base includes an outer thread configured to electrically connect a first terminal of the electric power supply to the first terminal of the heating elements. The electrode is used to electrically connect a second terminal of the electric power supply to the second terminal of the heating elements. The insulation cover positioned between the electric connector base and the electrode to provide insulation between the first and the second terminals of the electric power supply. The sealing ring is used to prevent vapor from leaking through the lower end of the mounting hole.

In certain embodiments, the first vaporizer heating assembly also includes: (a) a vapor tube and (b) a pressure sealing ring. The vapor tube is used to provide vapor to a user. The pressure sealing ring is used to prevent vapor from escaping from the vapor tube. The pressure sealing ring is positioned on the upper end of the cylindrical heating assembly base. The vapor tube is positioned on top of the pressure sealing ring.

In certain embodiments, the heating element has a heating wire. The heating wire has the first terminal to be connected to the first terminal of the electric power supply, and the second terminal to be connected to the second terminal of the electric power supply. The heating wire of the heating element is wound to form a flat surface. The flat surface may be in one of following shapes: (a) a spiral shape, (b) a parabolic spiral shape, (c) a rectangle shape, (d) a square shape, (e) a round shape, and (f) an oval shape.

The present invention also relates to an electronic cigarette that includes the first vaporizer heating assembly.

In another aspect, the present invention relates to a second vaporizer heating assembly for electronic cigarettes. In certain embodiments, the second vaporizer heating assembly includes: (a) a first "U" shaped vaporizer shield, and a second "U" shaped vaporizer shield, (b) a pair of e-liquid media, (c) one or more heating elements, and (d) a pair of sealing blocks.

In certain embodiments, the first "U" shaped vaporizer shield is positioned on a first side, and the second "U" shaped vaporizer shield is positioned on an opposite, second side, of a circular heating element base to form a substantially square vaporizing chamber. The vaporizing chamber has an open upper end, and an open lower end. Two gaps are defined on each side and between the first and the second vaporizer shields. An e-liquid conduit opening is defined on each of the first and the second vaporizer shields.

In certain embodiments, each of the pair of e-liquid media is detachably positioned inside of the first and the second vaporizer shields and is in communication with e-liquid through the e-liquid conduit opening, respectively.

In certain embodiments, each of the one or more heating elements is detachably positioned inside of the e-liquid media, respectively. Each of the one or more heating elements has a first terminal and a second terminal. Each of the pair of sealing blocks is detachably positioned between the two gaps, respectively, to form a vaporizing chamber between the one or more heating elements.

In certain embodiments, the second vaporizer heating assembly also has: (a) an electric connector base, (b) an electrode, and (c) an insulation cover. The electric connector base is attached to the open lower end of the vaporizing chamber and the electric connector base is used to connect an electric power supply to the second vaporizer heating assembly. The electric connector base has an outer thread configured to electrically connect a first terminal of the electric power supply to the first terminal of the heating elements.

In certain embodiments, the electrode is used to electrically connect a second terminal of the electric power supply to the second terminal of the heating elements. The insulation cover is positioned between the electric connector base and the electrode to provide insulation between the first and the second terminals of the electric power supply.

In certain embodiments, the heating element has a heating wire. The heating wire has the first terminal to be connected to the first terminal of the electric power supply, and the second terminal to be connected to the second terminal of the electric power supply. The heating wire of the heating element is wound to form a flat surface. The flat surface may be in one of following shapes: (a) a spiral shape, (b) a parabolic spiral shape, (c) a rectangle shape, (d) a square shape, (e) a round shape, and (f) an oval shape.

In certain embodiments, the second vaporizer heating assembly also includes: (a) a vapor tube for providing vapor to a user, and (b) an upper vaporizing chamber cover to prevent vapor from escaping through the vapor tube. The upper vaporizing chamber cover is positioned on the upper end of the vaporizing chamber, and the vapor tube is positioned on top of the upper vaporizing chamber cover.

The present invention also relates to an electronic cigarette that includes the second vaporizer heating assembly.

In yet another aspect, the present invention relates to a third vaporizer heating assembly for electronic cigarettes. In certain embodiments, the third vaporizer heating assembly includes: (a) a first vaporizer shield and a second vaporizer shield, (b) a first heating element and a second heating element, (c) a first e-liquid medium and a second e-liquid medium, (d) a first positioning block and a second positioning block, and (e) a vaporizing chamber side cover.

In certain embodiments, the first vaporizer shield is positioned on a first side, and the second vaporizer shield is positioned on an opposite, second side, of a circular heating element base. Each of the first and the second vaporizer shields defines an e-liquid opening. Each of the first and the second heating elements has a first terminal and a second terminal.

In certain embodiments, the first e-liquid medium is vertically positioned inside of the first vaporizer shield, and the second e-liquid medium is vertically positioned inside of the second vaporizer shield. Each of the first and the second e-liquid media has an exterior portion, an interior portion, and a medium layer. The first heating element is positioned inside of the medium layer between the exterior portion and the interior portion of the first e-liquid medium, the second heating element is positioned inside of the medium layer between the exterior portion and the interior portion of the second e-liquid medium. Each of the first and the second e-liquid media defines an air vent to provide vaporized e-liquid from the air vent to a user.

In certain embodiments, the first positioning block, and the second positioning block are vertically positioned between the first and the second e-liquid media to form a vaporizing chamber. The vaporizing chamber has an open upper end, and an open lower end. The vaporizing chamber side cover is used to surround the vaporizer shields, the e-liquid media, and the positioning blocks. The vaporizing chamber side cover defines a first e-liquid conduit opening on a first side, adjacent to and in communication with a first e-liquid opening of the first vaporizer shield, a second e-liquid conduit opening on an opposite side, adjacent to and in communication with the second e-liquid opening of the second vaporizer shield. A plurality of e-liquid medium side openings are defined on the adjacent sides of the vaporizing chamber side cover to expose e-liquid to the sides of the first and the second e-liquid media.

In certain embodiments, the third vaporizer heating assembly also has: (a) an electric connector base, (b) an electrode, and (c) an insulation cover. The electric connector base is attached to the open lower end of the vaporizing chamber and the electric connector base is used to connect an electric power supply to the third vaporizer heating assembly. The electric connector base has an outer thread configured to electrically connect a first terminal of the electric power supply to the first terminal of the heating elements.

In certain embodiments, the electrode is used to electrically connect a second terminal of the electric power supply to the second terminal of the heating elements. The insulation cover is positioned between the electric connector base and the electrode to provide insulation between the first and the second terminals of the electric power supply.

In certain embodiments, the heating element has a heating wire. The heating wire has the first terminal to be connected to the first terminal of the electric power supply, and the second terminal to be connected to the second terminal of the electric power supply. The heating wire of the heating element is wound to form a flat surface. The flat surface may be in one of following shapes: (a) a spiral shape, (b) a parabolic spiral shape, (c) a rectangle shape, (d) a square shape, (e) a round shape, and (f) an oval shape.

In certain embodiments, the third vaporizer heating assembly also includes: (a) a vapor tube for providing vapor to the user, and (b) a vaporizing chamber top cover coupled to the vapor tube to guide the vapor to the user through the vapor tube. The vaporizing chamber top cover is positioned on the upper end of the vaporizing chamber, and the vapor tube is positioned on top of the vaporizing chamber top cover.

The present invention also relates to an electronic cigarette that includes the third vaporizer heating assembly.

In a further aspect, the present invention relates to a fourth vaporizer heating assembly for electronic cigarettes. In certain embodiments, the fourth vaporizer heating assembly has: (a) a first vaporizer shield and a second vaporizer shield, (b) a first heating element and a second heating element, (c) a first e-liquid medium and a second e-liquid medium, (d) a first positioning block and a second positioning block, and (e) a vaporizing chamber side cover.

In certain embodiments, the first vaporizer shield is positioned on a first side, and the second vaporizer shield is positioned on an opposite, second side of a circular heating element base. Each of the first and the second vaporizer shields has a straight interior surface, and an arc exterior surface, and defines an e-liquid opening between the straight interior surface and the arc exterior surface. Each of the first heating element and the second heating element has a first terminal and a second terminal.

In certain embodiments, the first e-liquid medium is vertically positioned inside of the first vaporizer shield, and the second e-liquid medium is vertically positioned inside of the second vaporizer shield. Each of the first and the second e-liquid media has an exterior portion, an interior portion, and a medium layer. The first heating element is positioned inside of the medium layer between the exterior portion and the interior portion of the first e-liquid medium. The second heating element is positioned inside of the medium layer between the exterior portion and the interior portion of the second e-liquid medium. Each of the first and the second e-liquid media defines an air vent on the interior portion to provide vaporized e-liquid to a user.

In certain embodiments, the first positioning block and the second positioning block are vertically positioned between the first and the second e-liquid media to form a vaporizing chamber. The vaporizing chamber has an open upper end, and an open lower end. The cylindrical vaporizing chamber side cover is configured to surround the vaporizer shields, the e-liquid media, and the positioning blocks, wherein the vaporizing chamber side cover defines a first e-liquid conduit opening adjacent to and in communication with the first e-liquid opening of the first vaporizer shields, a second e-liquid conduit opening adjacent to and in communication with the second e-liquid opening of the second vaporizer shields, and a plurality of e-liquid medium side openings to expose e-liquid to the side of the first and the second e-liquid media.

In certain embodiments, the fourth vaporizer heating assembly has: (a) an electric connector base, (b) an electrode, and (c) an insulation cover. The electric connector base is attached to the open lower end of the vaporizing chamber and is used for connecting an electric power supply to the fourth vaporizer heating assembly. The electric connector base has an outer thread configured to electrically connect a first terminal of the electric power supply to the first terminal of the heating elements. The electrode is configured to electrically connect a second terminal of the electric power supply to the second terminal of the heating elements. The insulation cover is positioned between the electric connector base and the electrode to provide insulation between the first and the second terminals of the electric power supply.

In certain embodiments, the heating element has a heating wire. The heating wire has the first terminal to be connected to the first terminal of the electric power supply, and the second terminal to be connected to the second terminal of the electric power supply. The heating wire of the heating element is wound to form a flat surface. The flat surface may be in one of following shapes: (a) a spiral shape, (b) a parabolic spiral shape, (c) a rectangle shape, (d) a square shape, (e) a round shape, and (f) an oval shape.

In certain embodiments, the fourth vaporizer heating assembly also has: (a) a vapor tube, and (b) a round vaporizing chamber top cover. The vapor tube is used to provide vapor to the user. The round vaporizing chamber top cover is attached to the vapor tube to guide the vapor to the user through the vapor tube. The round vaporizing chamber top cover is positioned on the upper end of the vaporizing chamber, and the vapor tube is positioned on top of the round vaporizing chamber top cover.

The present invention also relates to an electronic cigarette that includes the fourth vaporizer heating assembly.

These and other aspects of the present invention will become apparent from the following description of the preferred embodiment taken in conjunction with the following drawings, although variations and modifications therein may be effected without departing from the spirit and scope of the novel concepts of the invention.

BRIEF DESCRIPTION OF THE DRAWINGS

The accompanying drawings illustrate one or more embodiments of the invention and, together with the written description, serve to explain the principles of the invention. Wherever possible, the same reference numbers are used throughout the drawings to refer to the same or like elements of an embodiment. The drawings do not limit the present invention to the specific embodiments disclosed and described herein. The drawings are not necessarily to scale, emphasis instead being placed upon clearly illustrating the principles of the invention, and wherein.

DETAILED DESCRIPTION

Figure 1:
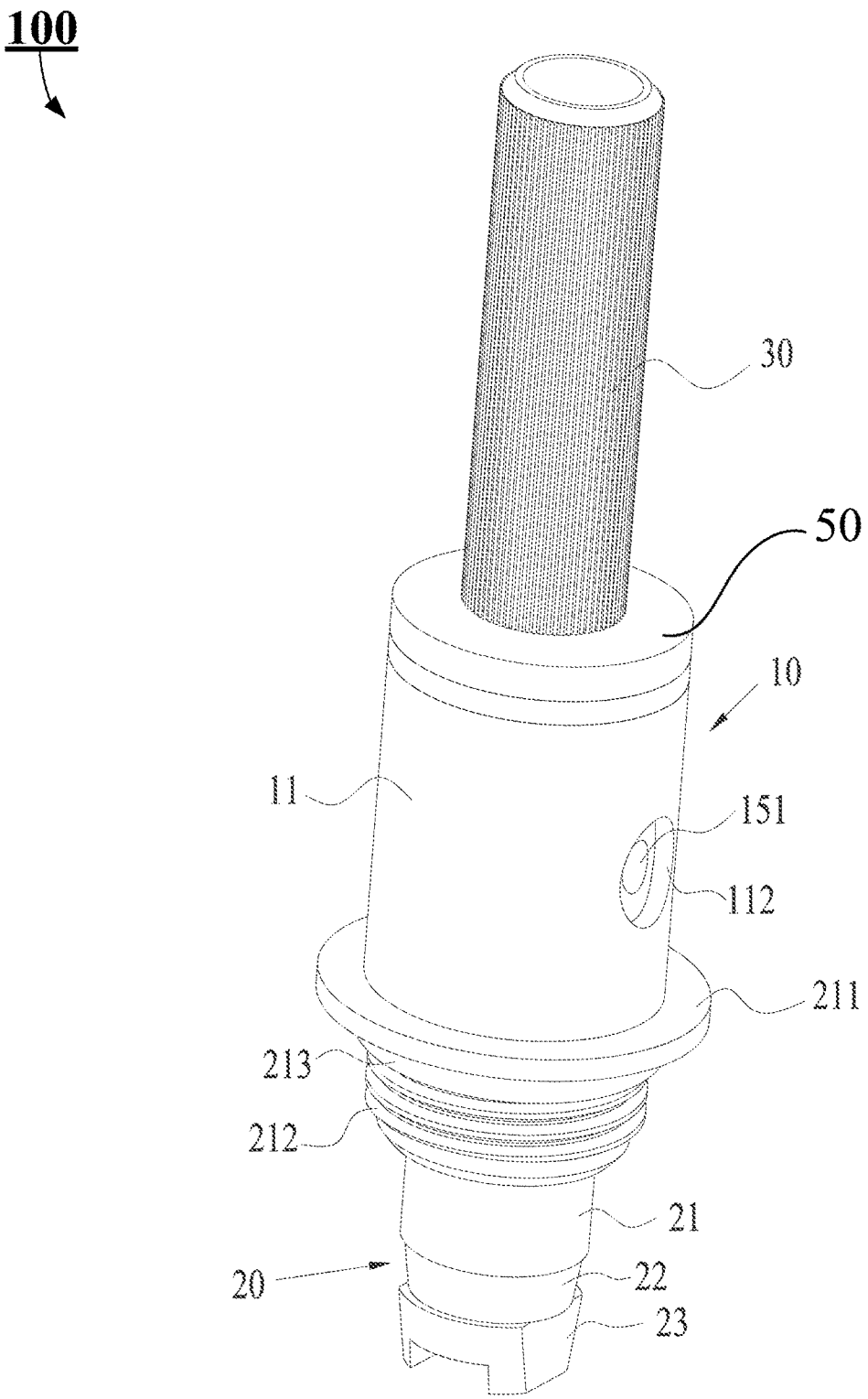
FIG. 1 is a perspective view of a first embodiment of a vaporizer heating assembly for electronic cigarettes according to certain embodiments of the present invention.

The present invention will now be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including" or "has" and/or "having" when used herein, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom", "upper" or "top," and "front" or "back" may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As used herein, "around", "about" or "approximately" shall generally mean within 20 percent, preferably within 10 percent, and more preferably within 5 percent of a given value or range. Numerical quantities given herein are approximates, meaning that the term "around", "about" or "approximately" can be inferred if not expressly stated.

Many specific details are provided in the following descriptions to make the present invention be fully understood, but the present invention may also be implemented by using other manners different from those described herein, so that the present invention is not limited by the specific embodiments disclosed in the following.

Figure 9:
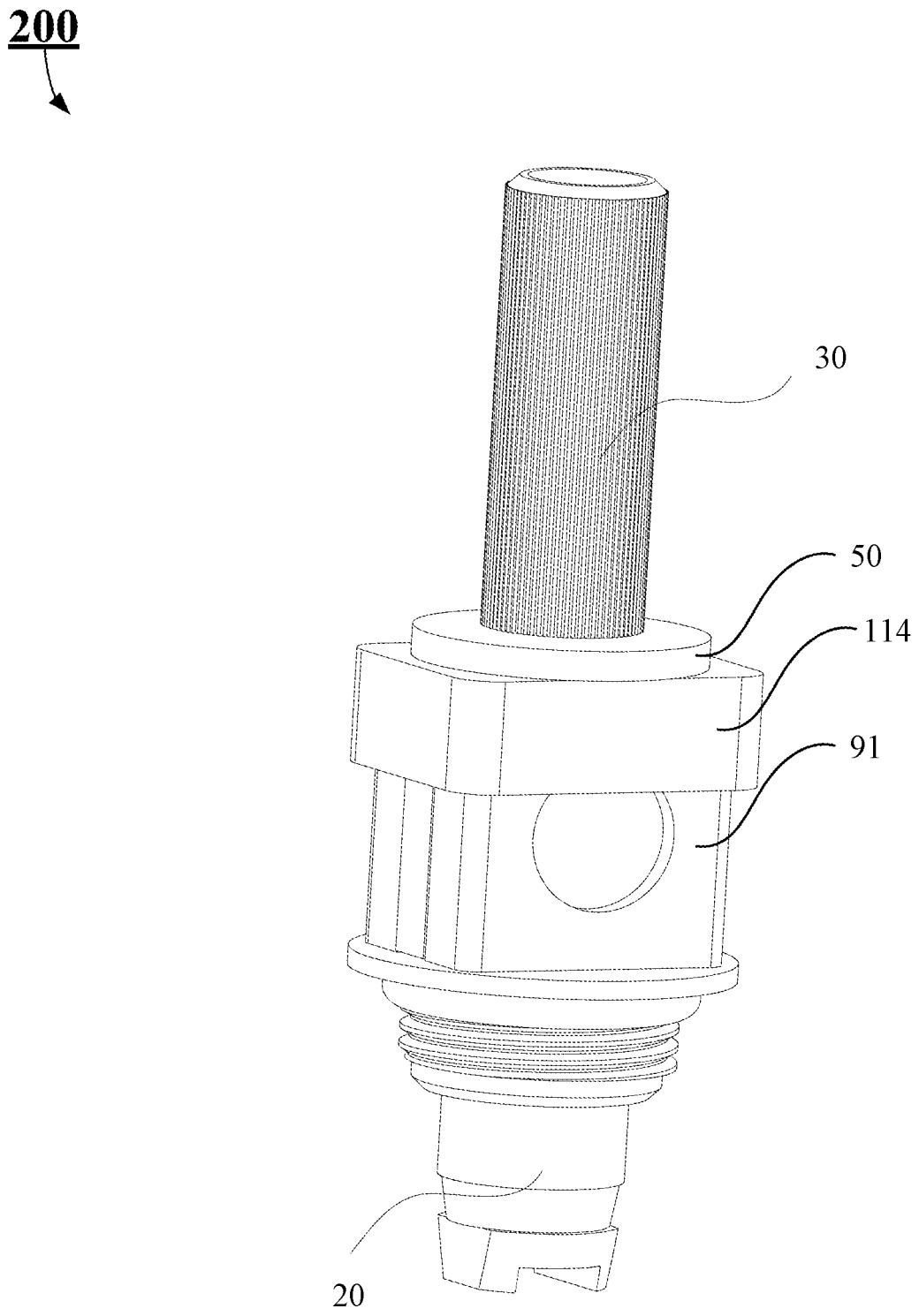
FIG. 9 is a perspective view of a second embodiment of the vaporizer heating assembly for electronic cigarettes according to certain embodiments of the present invention.
Figure 10:
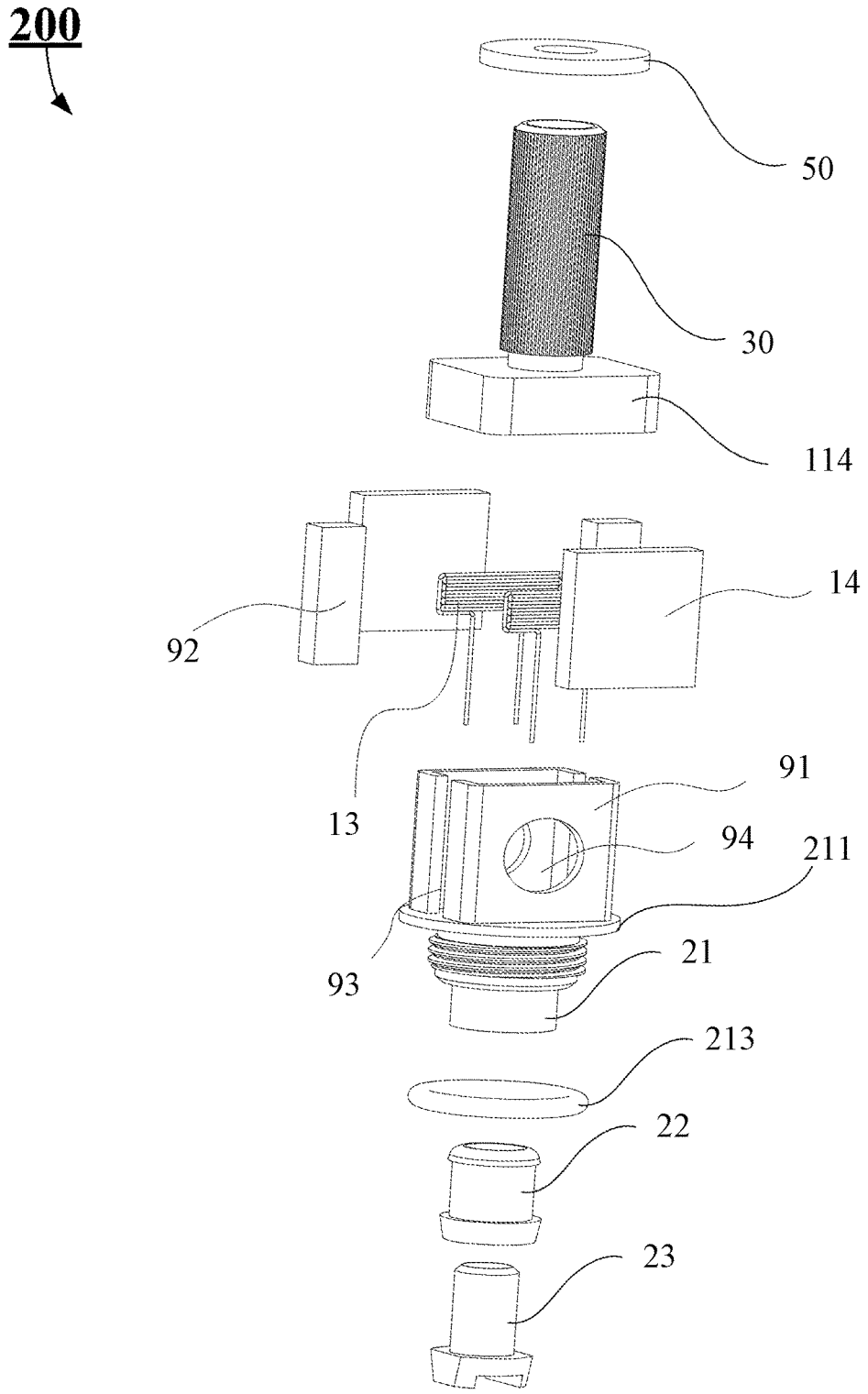
FIG. 10 shows an exploded view of the second embodiment of the vaporizer heating assembly according to certain embodiments of the present invention.
Figure 11:
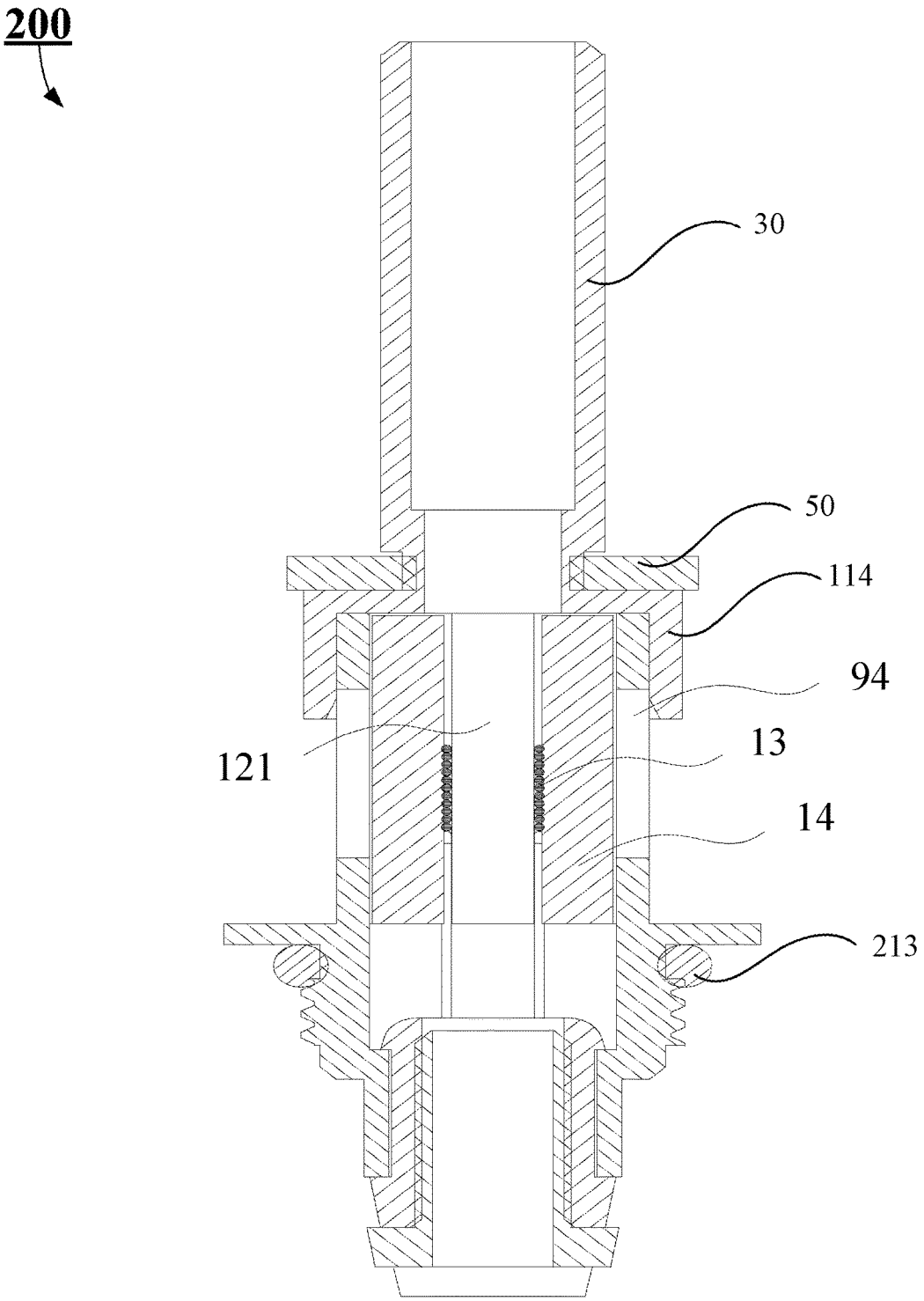
FIG. 11 shows a cross sectional view of the second embodiment of the vaporizer heating assembly according to certain embodiments of the present invention.
Figure 12:
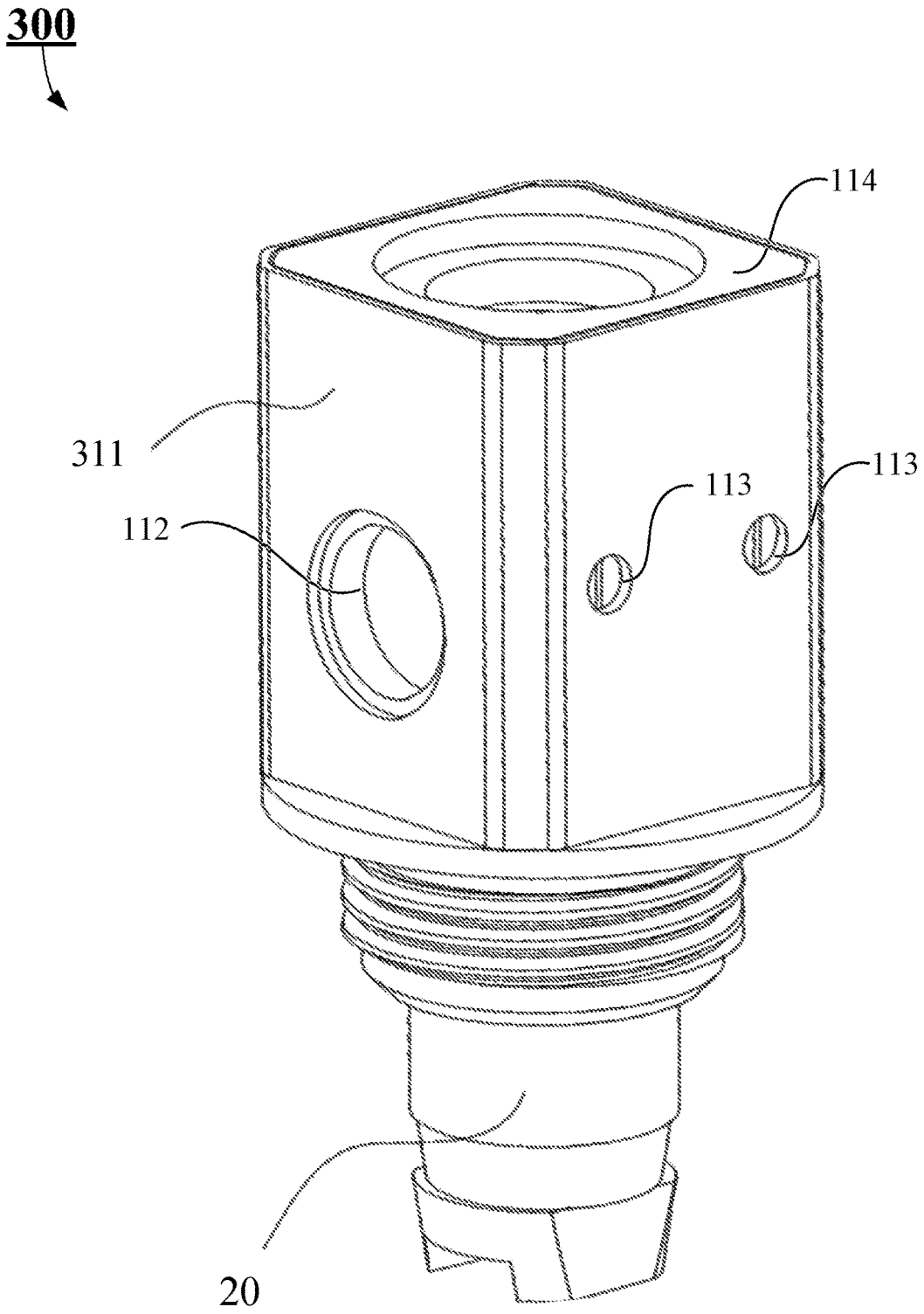
FIG. 12 shows a perspective view of a third embodiment of the vaporizer heating assembly according to certain embodiments of the present invention.
Figure 13:
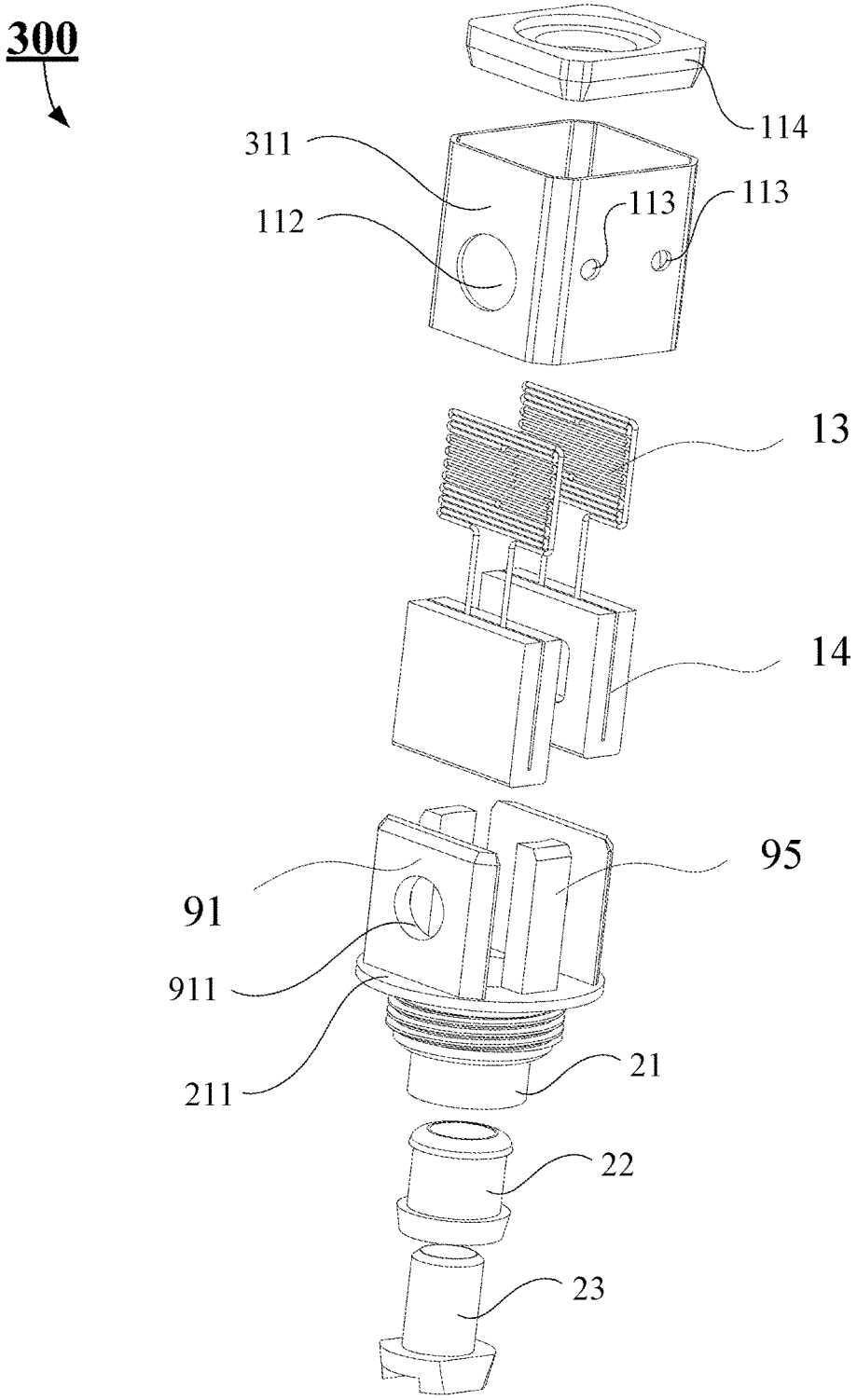
FIG. 13 shows an exploded perspective view of the third embodiment of the vaporizer heating assembly according to certain embodiments of the present invention.
Figure 14:
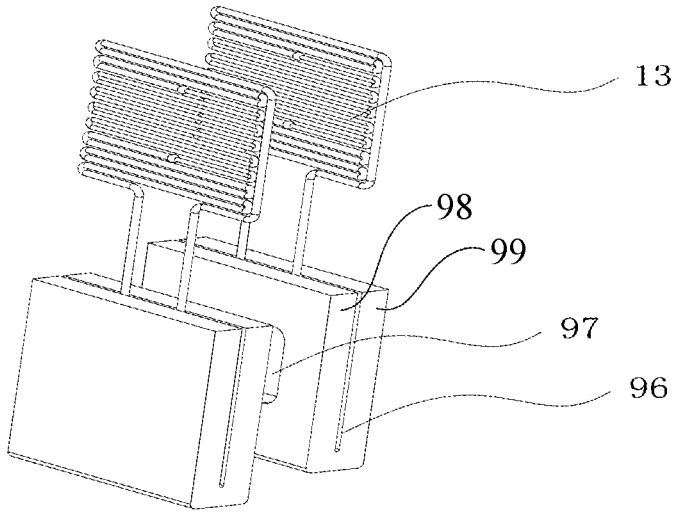
FIG. 14 shows a perspective view of an e-liquid medium of the third embodiment of the vaporizer heating assembly according to certain embodiments of the present invention.
Figure 15:
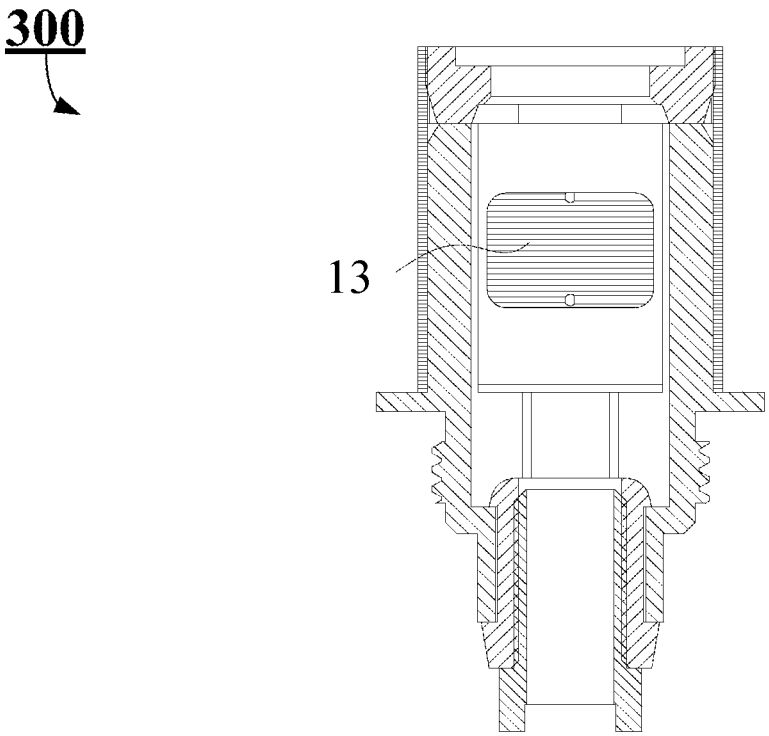
FIG. 15 shows a cross sectional view of the third embodiment of the vaporizer heating assembly according to certain embodiments of the present invention.
Figure 16:
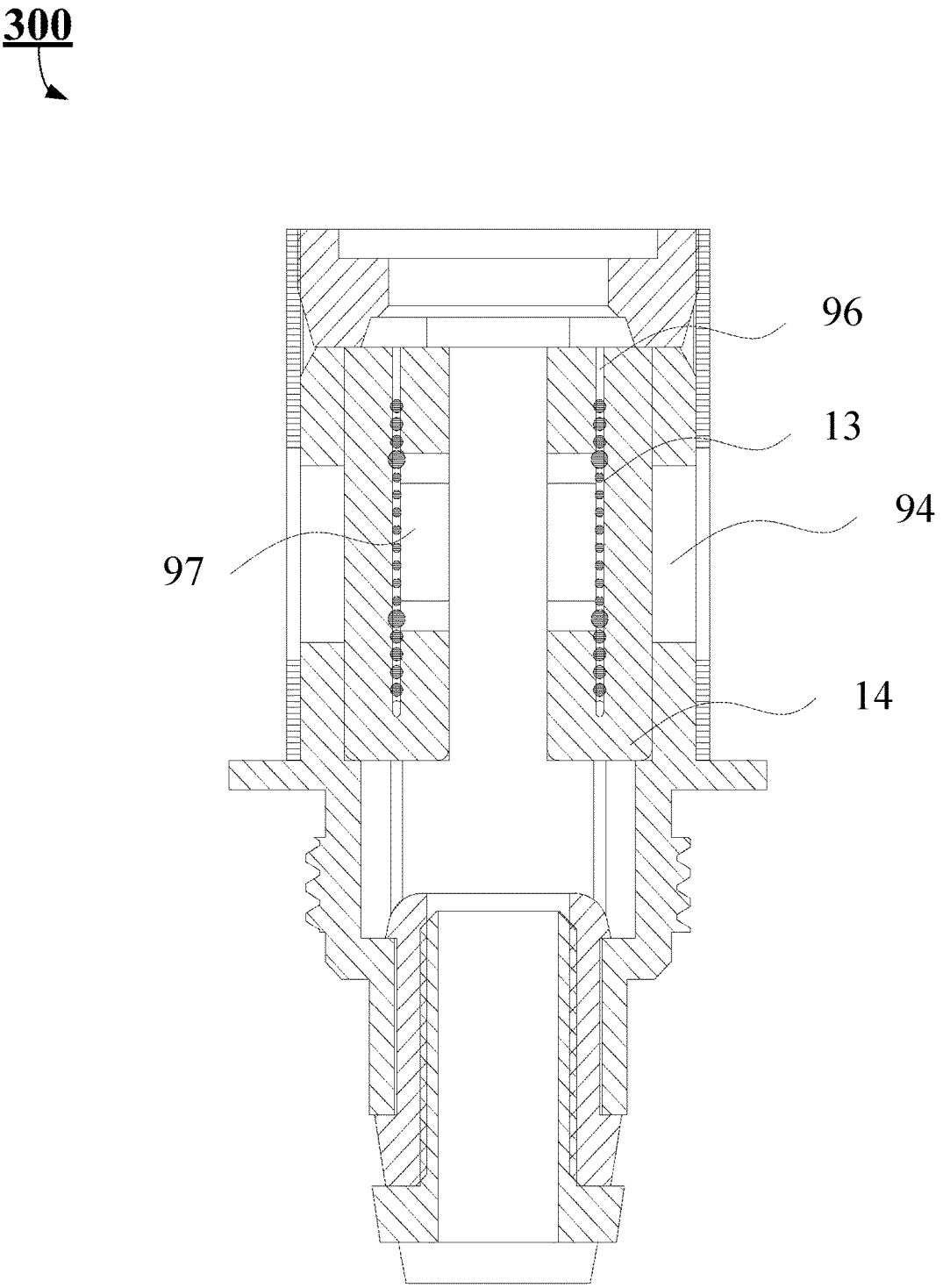
FIG. 16 shows another cross sectional view of the third embodiment of the vaporizer heating assembly from a different angle according to certain embodiments of the present invention.
Figure 17:
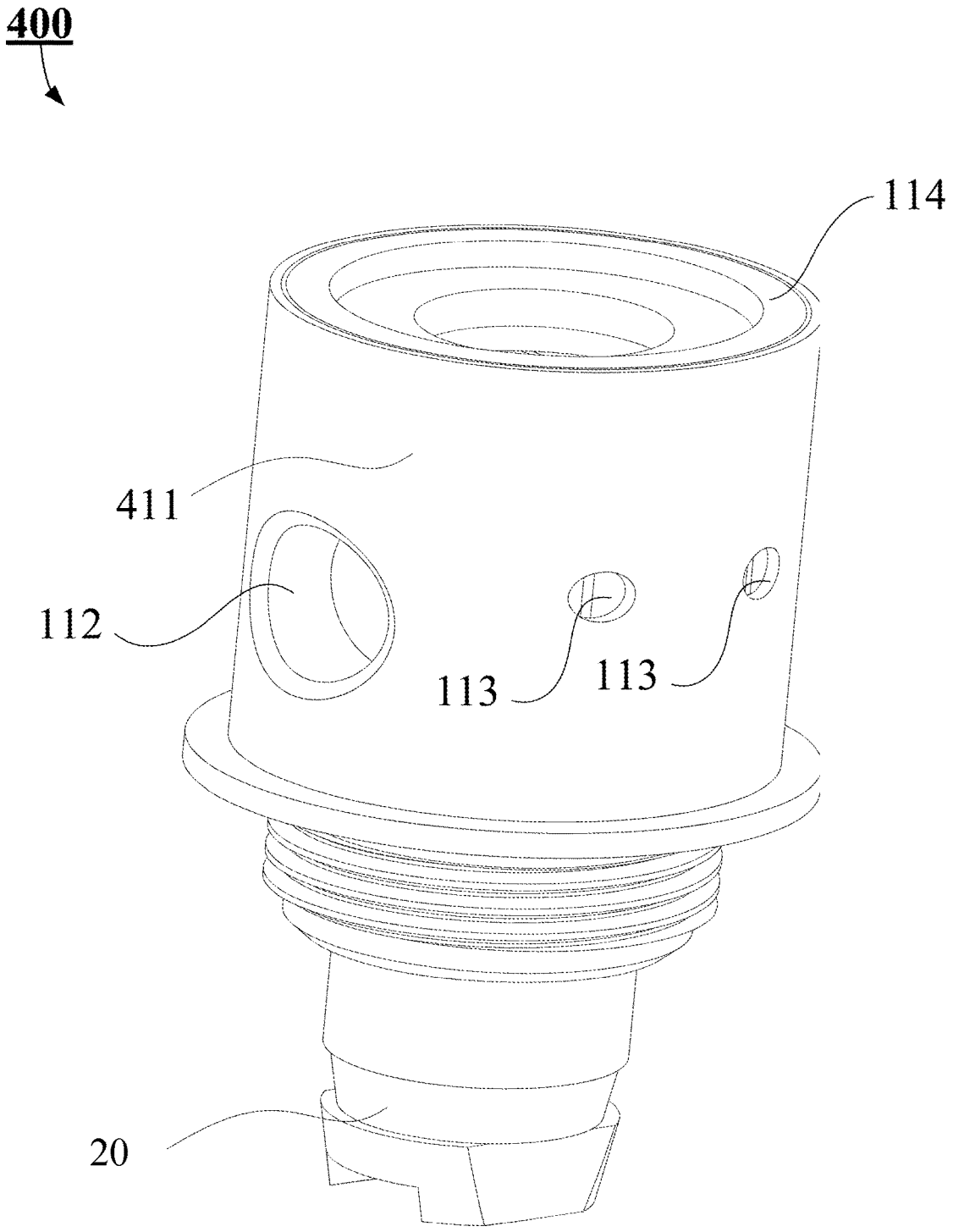
FIG. 17 shows a perspective view of a fourth embodiment of the vaporizer heating assembly according to certain embodiments of the present invention.
Figure 18:
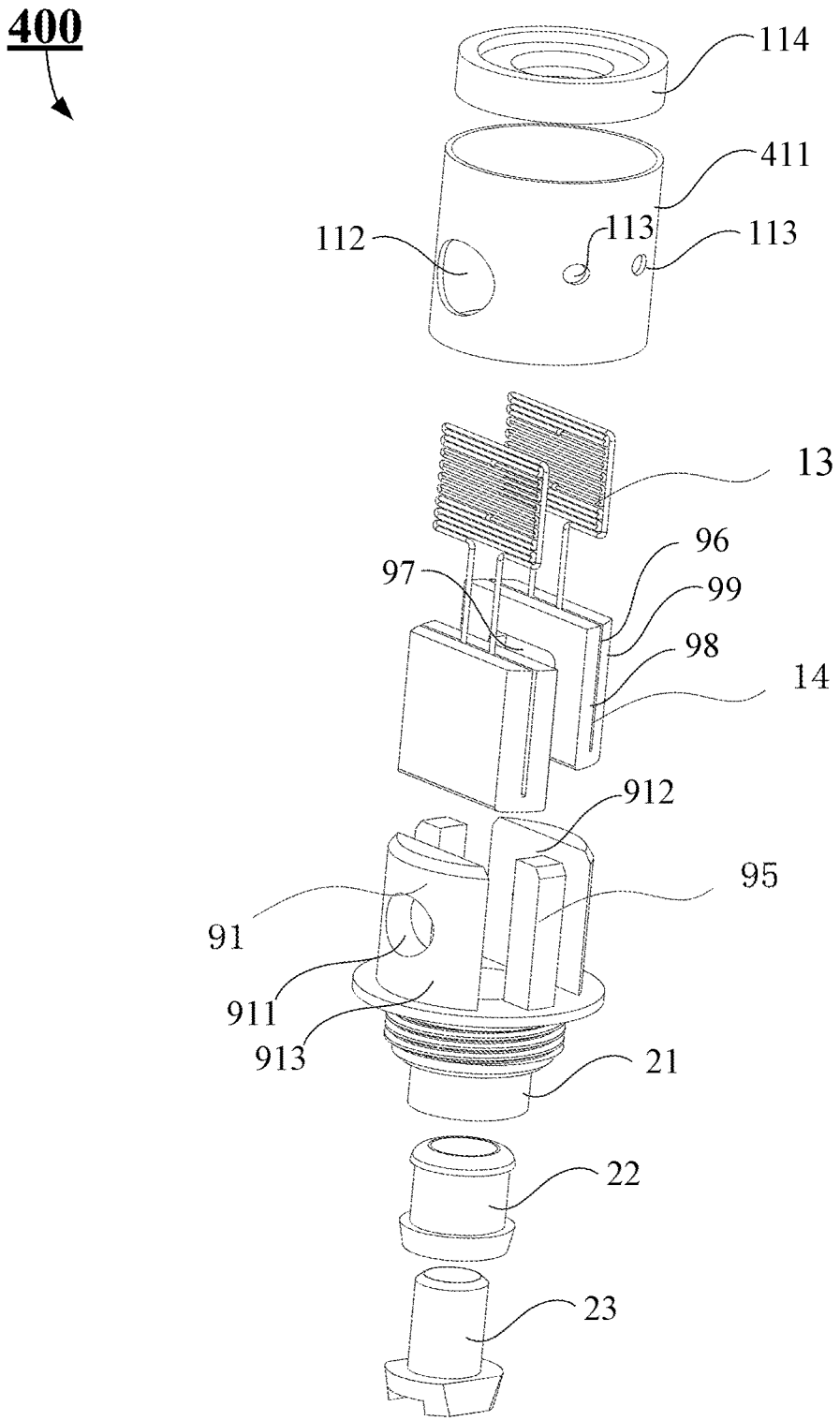
FIG. 18 shows an exploded perspective view of the fourth embodiment of the vaporizer heating assembly according to certain embodiments of the present invention.
Figure 19:
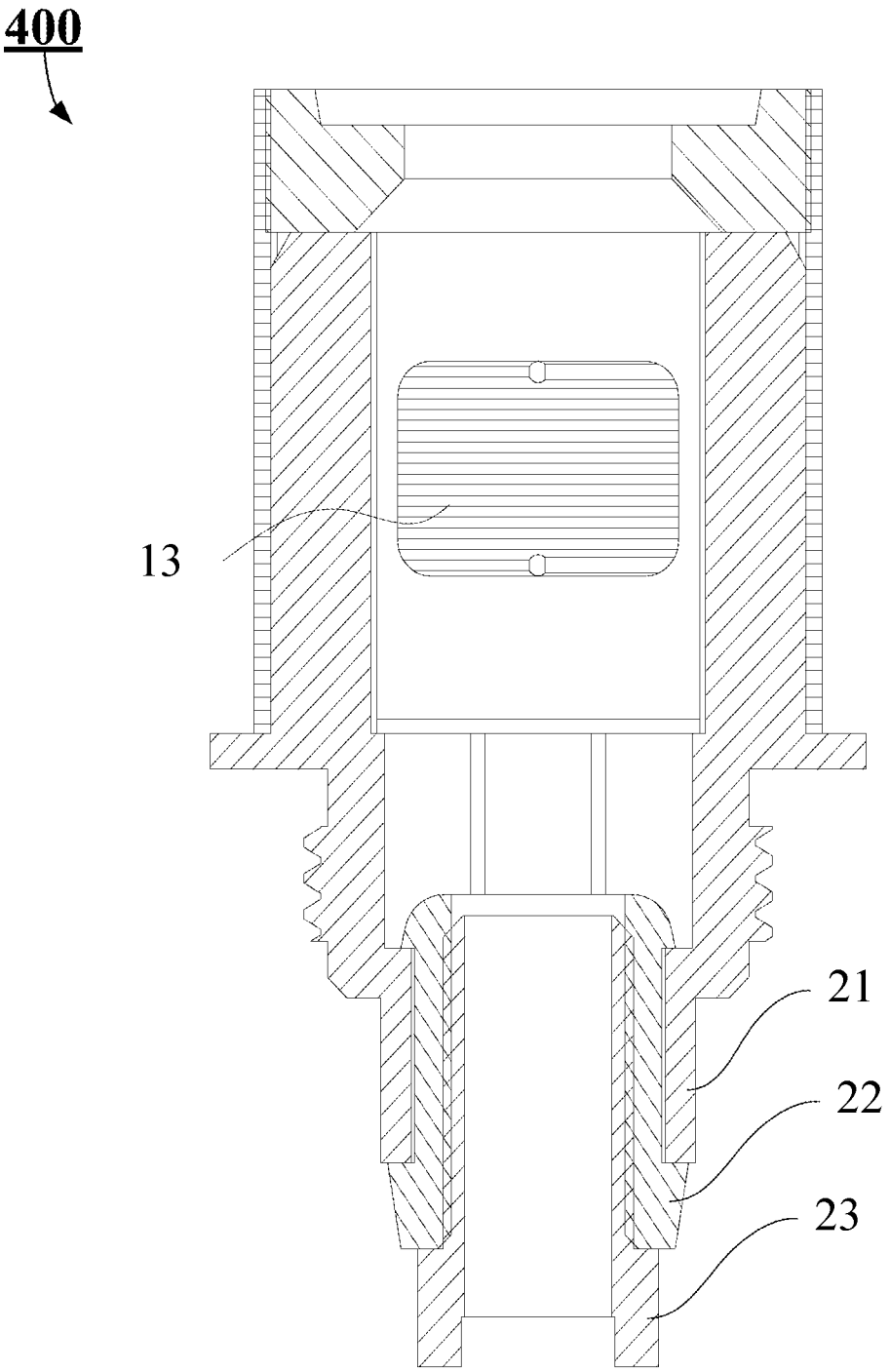
FIG. 19 shows a cross sectional view of the fourth embodiment of the vaporizer heating assembly according to certain embodiments of the present invention.
Figure 20:
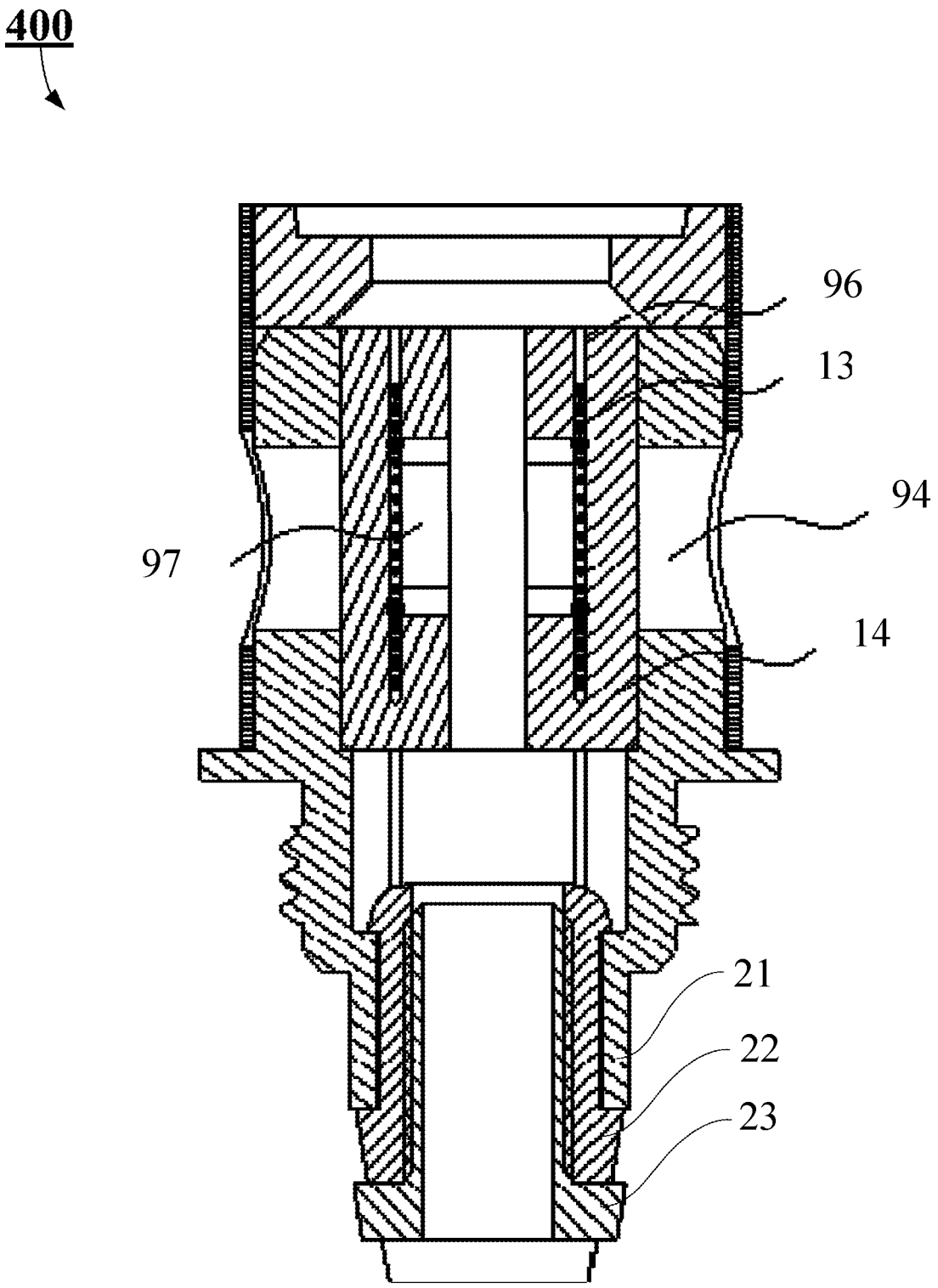
FIG. 20 shows another cross sectional view of the fourth embodiment of the vaporizer heating assembly from a different angle according to certain embodiments of the present invention.

The description will be made as to the embodiments of the present invention in conjunction with the accompanying drawings FIGS. 1 through 20. According to certain embodiments of the present invention, FIGS. 1 through 8 show a first embodiment 100 of a vaporizer heating assembly for electronic cigarettes. FIGS. 9 through 11 show a second embodiment 200 of the vaporizer heating assembly. FIGS. 12 through 16 show a third embodiment 300 of the vaporizer heating assembly. FIGS. 17 through 20 show a fourth embodiment 400 of the vaporizer heating assembly.

Figure 2:
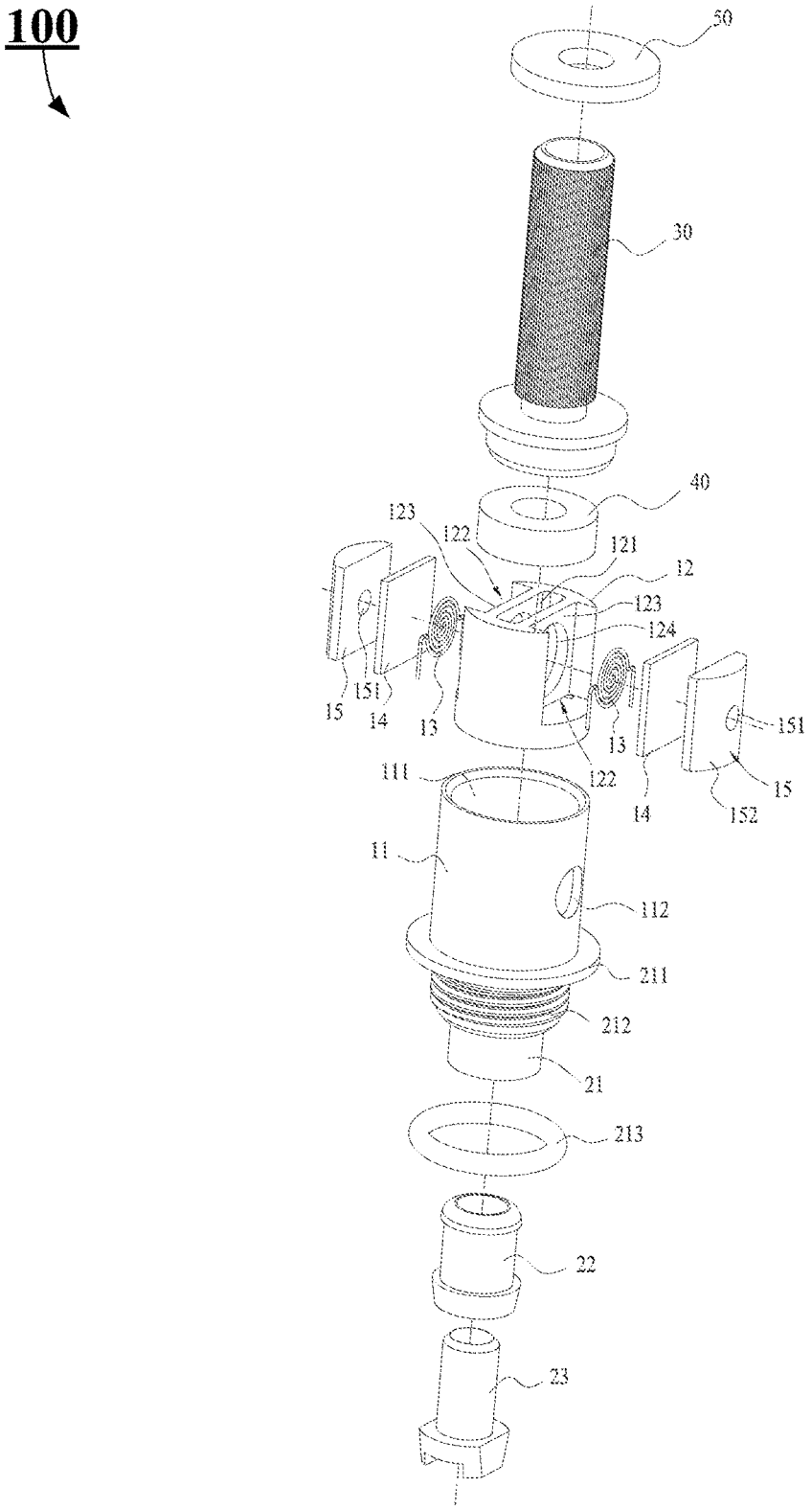
FIG. 2 shows an exploded perspective view of the first embodiment of the vaporizer heating assembly according to certain embodiments of the present invention.
Figure 3:
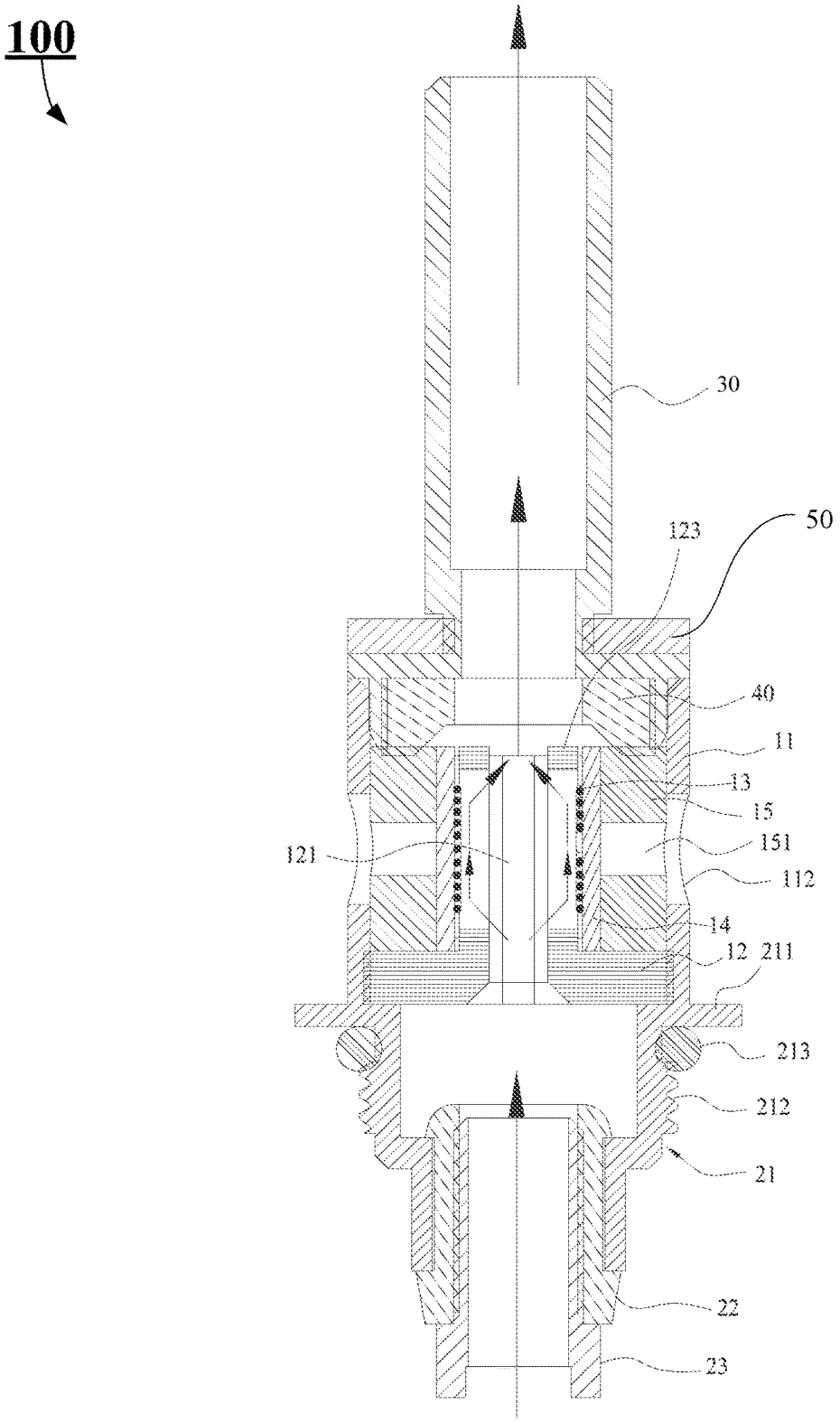
FIG. 3 shows a cross sectional view of the first embodiment of the vaporizer heating assembly illustrating air flow of vaporized e-liquid according to certain embodiments of the present invention.

In accordance with the purposes of this invention, as embodied and broadly described herein, this invention, in one aspect, relates to a first vaporizer heating assembly 100 of electronic cigarettes (e-cigarette). In certain embodiments, as shown in FIGS. 1-3, the first vaporizer heating assembly 100 includes: (a) cylindrical heating assembly cover 11, (b) a circular heating element mounting base 12, (c) one or more heating elements 13, (d) certain e-liquid media 14, and (e) certain e-liquid medium arches 15.

In certain embodiments, the cylindrical heating assembly cover 11 is positioned on a circular heating element base 211. The cylindrical heating assembly cover 11 has an open upper end defining a mounting hole 111, and an opposite, open lower end. A first e-liquid conduit opening 112 is defined on a first side of middle section of the cylindrical heating assembly cover 11, and a second e-liquid conduit opening 112 is defined an opposite, second side of the middle section of the cylindrical heating assembly cover 11.

The circular heating element mounting base 12 is detachably positioned inside of the cylindrical heating assembly cover 11. The circular heating element mounting base 12 has two upright arches on opposite side of the circular heating element mounting base 12, with two upright separator plates 123 connecting the two upright arches and defines a mounting base air vent 121 inside of the two separator plates 123. The mounting base air vent 121 is open from the bottom of the circular heating element mounting base 12 to the top of the circular heating element mounting base 12. Two mounting portions 122 are defined outside of the two separator plates 123. Each of the two separator plates 123 defines a heating element opening 124.

Each of the heating elements 13 is positioned inside the heating element opening 124 of each of the separator plates 123, respectively. Each of the heating elements 13 has a first terminal, and a second terminal. Each of the e-liquid media 14 is detachably positioned outside of each of the heating elements 13 in each of the mounting portions 122, respectively. Each of the e-liquid medium arches 15 is detachably positioned outside each of the e-liquid media 14, respectively. Each of the e-liquid medium arches 15 defines an e-liquid opening 151. Each of the e-liquid openings 151 is in communication with the e-liquid conduit opening 112 to allow e-liquid to flow through the e-liquid conduit opening 112 to reach the e-liquid media 14.

In certain embodiments, the first vaporizer heating assembly 100 also includes: (a) a vapor tube 30, (b) a pressure sealing ring 40, and (c) a sealing cushion 50. The vapor tube 30 is used to provide vaporized e-liquid to a user. The pressure sealing ring 40 is used to prevent vapor from escaping from the vapor tube 30. The pressure sealing ring 40 is positioned on the upper end of the cylindrical heating assembly cover 11. The vapor tube 30 is positioned on top of the pressure sealing ring 40. The sealing cushion 50 is used for sealing the vaporized e-liquid from escaping from the e-cigarette body to be installed outside of the first vaporizer heating assembly 100.

In certain embodiments, the heating elements 13 are installed in the heating element opening 124, one on each side. The e-liquid media 14 are installed outside of the heating elements 13 in the mounting portions 122, and in direct contact with the heating elements 13, respectively. Then the e-liquid medium arches 15 are placed outside of the e-liquid media 14 also in the mounting portions 122, respectively. Once these parts are placed on the circular heating element mounting base 12, the entire assembly is placed in the cylindrical heating assembly cover 11. The pressure sealing ring 40 is then installed on the top of the first vaporizer heating assembly 100 to allow the vaporized e-liquid to go through a center air passage of the vapor tube 30 to reach the user.

In certain embodiments, the first vaporizer heating assembly 100 also has an electrical conductor assembly 20. The electrical conductor assembly 20 has: (a) an electric connector base 21, (b) an electrode 23, and (c) an insulation cover 22. The electric connector base 21 is attached to the open lower end of the cylindrical heating assembly cover 11 and adapted for connecting an electric power supply to the first vaporizer heating assembly 100. The electric connector base 21 includes an outer thread 212 configured to electrically connect a first terminal of the electric power supply to the first terminal of the heating elements 13. The electrode 23 is used to electrically connect a second terminal of the electric power supply to the second terminal of the heating elements 13. The insulation cover 22 positioned between the electric connector base 21 and the electrode 23 to provide insulation between the first and the second terminals of the electric power supply. In certain embodiments, the electrical conductor assembly 20 also has a sealing ring 213. The sealing ring 213 is used to secure the connection between the outer thread 212 and a heating assembly holder 64.

In certain embodiments, as shown in FIG. 3, the air to be used for vaporizing e-liquid enters the first vaporizer heating assembly 100 from the bottom of the electrode 23 and goes through the electrode 23, the insulation cover 22, the lower end of the mounting hole 111, and enters the mounting base air vent 121.

In certain embodiments, e-liquid is stored in an e-liquid storage 70, located outside of the cylindrical heating assembly cover 11. The e-liquid is exposed to the e-liquid openings 151 on the e-liquid medium arches 15. Each of the e-liquid opening 151 is in communication with the e-liquid conduit opening 112 of the cylindrical heating assembly cover 11 to allow e-liquid to flow through the e-liquid conduit opening 112 to reach the e-liquid media 14. When the heating elements 13 are powered by the electric power supply, the e-liquid on the e-liquid media 14 is heated by the heating elements 13 and vaporized. The air in the mounting base air vent 121 goes up between the separator plates 123 and exits through an air passage of the pressure sealing ring 40, and the vapor tube 30 to the user. The arrows in FIG. 3 illustrate the direction of air flow inside of the first vaporizer heating assembly 100.

Referring to FIGS. 4-7, in certain embodiments, the heating element 13 has a heating wire. The heating wire has the first terminal to be connected to the first terminal of the electric power supply, and the second terminal to be connected to the second terminal of the electric power supply. The heating wire of the heating element 13 is wound to form a flat surface. The flat surface may be in one of following shapes: (a) a spiral shape, (b) a parabolic spiral shape, (c) a rectangle shape, (d) a square shape, (e) a round shape, and (f) an oval shape.

Figure 4:
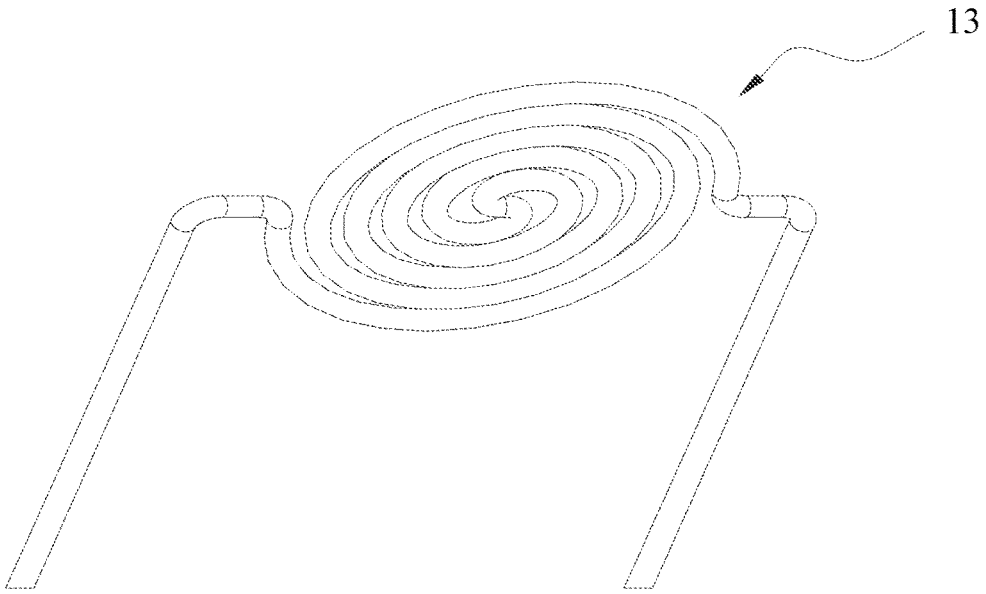
FIG. 4 shows a perspective view of a first embodiment of a heating element according to certain embodiments of the present invention.

In a first embodiment as shown in FIG. 4, the heating wire of the heating element 13 is arranged in a parabolic spiral shape having the first terminal and the second terminal on each side of the heating element 13.

Figure 5:
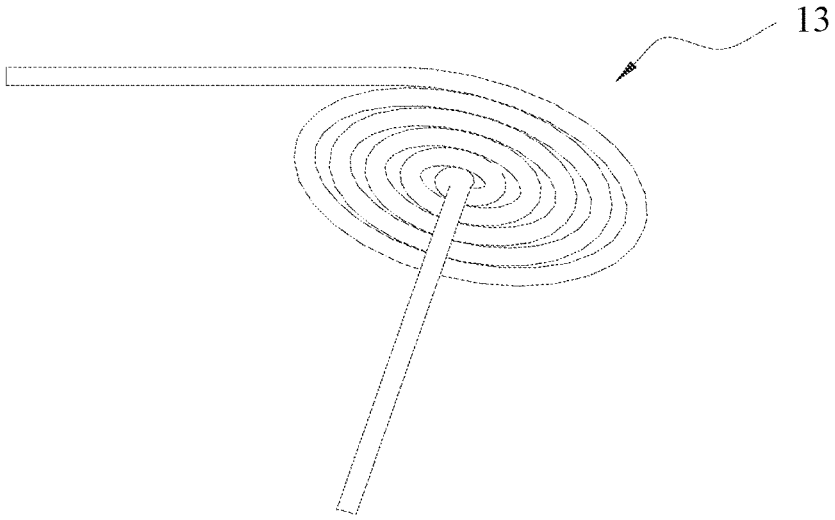
FIG. 5 shows a perspective view of a second embodiment of the heating element according to certain embodiments of the present invention.

In a second embodiment as shown in FIG. 5, the heating wire of the heating element 13 is arranged in a spiral shape having the first terminal in the center of the heating element 13, and the second terminal on the side of the heating element 13.

Figure 6:
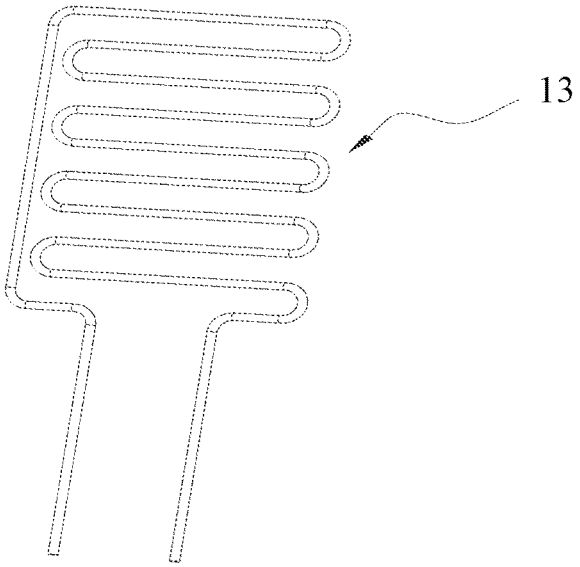
FIG. 6 shows a perspective view of a third embodiment of the heating element according to certain embodiments of the present invention.

In a third embodiment as shown in FIG. 6, the heating wire of the heating element 13 is arranged in a rectangular shape having the first terminal and the second terminal arranged at the lower end of the heating element 13.

Figure 7:
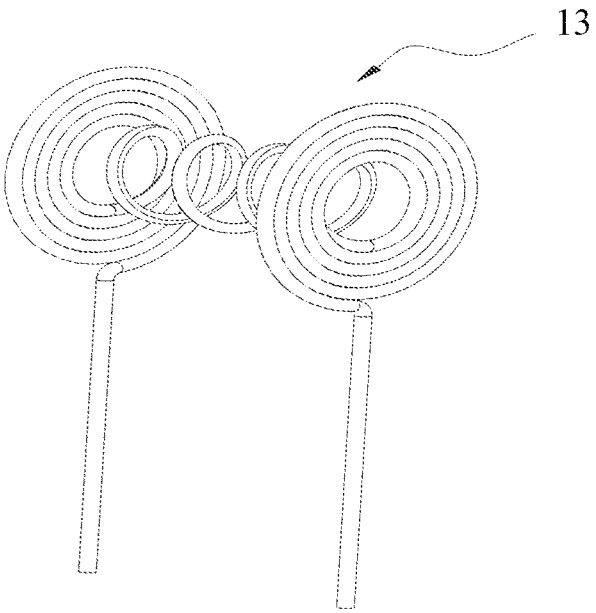
FIG. 7 shows a perspective view of a fourth embodiment of the heating element according to certain embodiments of the present invention.

In a fourth embodiment as shown in FIG. 7, two heating elements 13 are arranged in spiral shape and the center first terminals of the two heating elements 13 are connected to form a single heating element 13.

Figure 8:
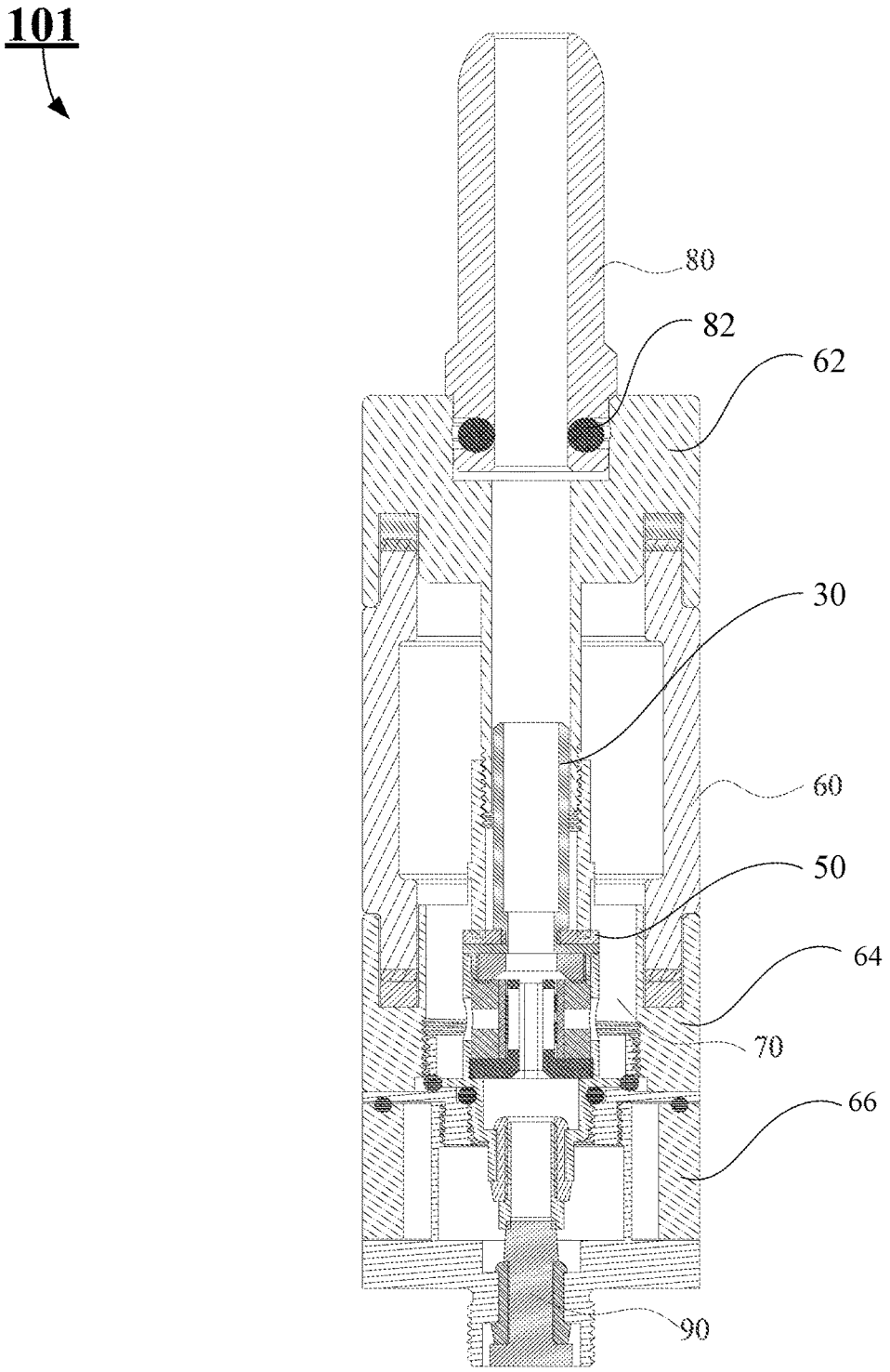
FIG. 8 shows a cross sectional view of an electronic cigarette having the first embodiment of the vaporizer heating assembly according to certain embodiments of the present invention.

In certain embodiments, the present invention also relates to an electronic cigarette 101 that includes the first vaporizer heating assembly 100 as shown in FIG. 8. The electronic cigarette 101 has: (a) a mouthpiece 80, (b) an upper body portion 62, (c) a middle body portion 60, (d) a heating assembly holder 64, and (e) a lower body portion 66. The upper body portion 62, the middle body portion 60, the heating assembly holder 64, and the lower body portion 66 are all cylindrical. A center air passage is defined through the mouthpiece 80, the upper body portion 62, the middle body portion 60, the heating assembly holder 64, and the lower body portion 66. The mouthpiece 80 is insertably installed in a top end of the upper body portion 62 with a sealing ring 82 to prevent the air vapor to escape. The upper body portion 62 is insertedly installed on a top end of the middle body portion 60, and the middle body portion 60 is insertably installed on a top end of the heating assembly holder 64. The first vaporizer heating assembly 100 is installed inside of the heating assembly holder 64. The lower body portion 66 is installed on the electric connector base 21 through the outer thread 212 configured to electrically connect a first terminal of the electric power supply to the first terminal of the heating elements 13. A connecting assembly 90 is installed in the center of the lower body portion 66 to connect to the electrode 23 to provide the second terminal of the electric power supply to the second terminal of the heating elements 13.

In certain embodiments, the electronic cigarette 101 has an e-liquid storage 70 to store e-liquid. The e-liquid storage 70 is defined inside of the middle body portion 60. The e-liquid in the e-liquid storage 70 is soaked into the e-liquid media 14 through e-liquid conduit opening 112 of the cylindrical heating assembly cover 11, and the e-liquid opening 151 of the e-liquid medium arches 15, on both sides. When the user turns on the electric power supply, the heating wires of the heating elements 13 are energized and heat up the e-liquid soaked in the e-liquid media 14 to vaporize the e-liquid therein, and create e-liquid vapor. When the user sucks the mouthpiece 80, the vapor goes up through a vaporizing chamber inside the upright separator plates 123, and the mounting base air vent 121 to the mouthpiece 80 to reach the user. The e-liquid continues to come into the e-liquid media 14, and burned off by the heating elements 13, and the vaporizing process is repeated.

In certain embodiments, the heating elements 13 are arranged in the large flat surface, the heat exchange between the e-liquid soaked in the e-liquid media 14 and the heating wires are even, and the e-liquid is sufficiently vaporized to create unusually large amount of vapor. Therefore, the vaporizing process has very high efficiency. Only the e-liquid vapor reaches the user, and the residue of the e-liquid will remain at the bottom of the vaporizing chamber inside of the mounting base air vent 121, and will not reach the user. In certain embodiments, the e-liquid media 14 are made of various fibers such as cotton, polypropylene fiber, terylene fiber, or nylon fiber. The e-liquid medium arches 15 are made of various fibers or porous ceramic material. In certain embodiments, the mounting base air vent 121 may be enlarged to produce even more vapor. The upright separator plates 123 may be increased to more than two pieces for each heating assembly 100.

In certain embodiments, in order to simulate the cigarette smoking, the outside shape of the electronic cigarette 101, the mouthpiece 80, the upper body portion 62, the middle body portion 60, the heating assembly holder 64, and the lower body portion 66 are all in round shapes.

In certain embodiments, the e-liquid conduit opening 112 of the cylindrical heating assembly cover 11, the e-liquid opening 151 of the e-liquid medium arch 15, and the heating element opening 124 of the of the circular heating element mounting base 12 are arranged in a coaxial manner so that the flow of the e-liquid from the e-liquid storage 70 to the heating elements 13 is smooth, that sufficient e-liquid is retained in the e-liquid media 14 for efficient vaporization, and that the e-liquid media 14 will not be too dry to create burning smell.

Referring now to FIGS. 9-11, in another aspect, the present invention relates to a second vaporizer heating assembly 200 for electronic cigarettes. In certain embodiments, the second vaporizer heating assembly 200 includes: (a) a first "U" shaped vaporizer shield 91, and a second "U" shaped vaporizer shield 91, (b) a pair of e-liquid media 14, (c) a pair of heating elements 13, and (d) a pair of sealing blocks 92.

In certain embodiments, the first "U" shaped vaporizer shield 91 is positioned on a first side, and the second "U" shaped vaporizer shield 91 is positioned on an opposite, second side, of a circular heating element base 211 to form a substantially square vaporizing chamber. The vaporizing chamber has an open upper end, and an open lower end. Two gaps 93 are defined on each side and between the first and the second vaporizer shields 91. An e-liquid conduit opening 94 is defined on each of the first and the second vaporizer shields 91.

In certain embodiments, each of the pair of e-liquid media 14 is detachably positioned inside of the first and the second vaporizer shields 91 and is in communication with e-liquid through the e-liquid conduit opening 94, respectively.

In certain embodiments, each of the heating elements 13 is detachably positioned inside of the e-liquid media 14, respectively. Each of the one or more heating elements 13 has a first terminal and a second terminal. Each of the pair of sealing blocks 92 is detachably positioned in each of the two gaps 93, respectively, to seal the two gaps and to form the vaporizing chamber between the heating elements 13.

In certain embodiments, the second vaporizer heating assembly 200 also has an electrical conductor assembly 20. The electrical conductor assembly 20 has: (a) an electric connector base 21, (b) an electrode 23, and (c) an insulation cover 22. The electric connector base 21 is attached to the open lower end of the vaporizing chamber and the electric connector base 21 is used to connect an electric power supply to the second vaporizer heating assembly 200. The electric connector base 21 has an outer thread 212 configured to electrically connect a first terminal of the electric power supply to the first terminal of the heating elements 13. In certain embodiments, the electrical conductor assembly 20 also has a sealing ring 213. The sealing ring 213 is used to secure the connection between the outer thread 212 and a heating assembly holder 64.

In certain embodiments, the electrode 23 is used to electrically connect a second terminal of the electric power supply to the second terminal of the heating elements 13. The insulation cover 22 is positioned between the electric connector base 21 and the electrode 23 to provide insulation between the first and the second terminals of the electric power supply.

In certain embodiments, the heating element 13 has a heating wire. The heating wire has the first terminal to be connected to the first terminal of the electric power supply, and the second terminal to be connected to the second terminal of the electric power supply. The heating wire of the heating element 13 is wound to form a flat surface as shown in FIGS. 4-7. The flat surface may be in one of following shapes: (a) a spiral shape, (b) a parabolic spiral shape, (c) a rectangle shape, (d) a square shape, (e) a round shape, and (f) an oval shape.

In certain embodiments, the second vaporizer heating assembly 200 also includes: (a) a vapor tube 30 for providing vapor to a user, and (b) an upper vaporizing chamber cover 114 to prevent vapor from escaping through the vapor tube 30. The upper vaporizing chamber cover 114 is positioned on an upper end of the vaporizing chamber, and the vapor tube 30 is positioned on top of the upper vaporizing chamber cover. In certain embodiments, the second vaporizer heating assembly 200 also has a sealing cushion 50 installed between the vapor tube 30 and the upper vaporizing chamber cover 114 to seal connection to a heating assembly holder to prevent the vapor to leak between the vapor tube 30 and the upper vaporizing chamber cover 114.

In certain embodiments, the present invention also relates to an electronic cigarette that includes the second vaporizer heating assembly 200. The electronic cigarette has: (a) a mouthpiece 80, (b) an upper body portion 62, (c) a middle body portion 60, (d) a heating assembly holder 64, and (e) a lower body portion 66. The upper body portion 62, the middle body portion 60, the heating assembly holder 64, and the lower body portion 66 are all cylindrical. A center air passage is defined through the mouthpiece 80, the upper body portion 62, the middle body portion 60, the heating assembly holder 64, and the lower body portion 66. The mouthpiece 80 is insertably installed in a top end of the upper body portion 62 with a sealing ring 82 to prevent the air vapor to escape. The upper body portion 62 is insertedly installed on a top end of the middle body portion 60, and the middle body portion 60 is insertably installed on a top end of the heating assembly holder 64. The heating assembly 200 is installed inside of the heating assembly holder 64. The lower body portion 66 is installed on the electric connector base 21 through the outer thread 212 configured to electrically connect a first terminal of the electric power supply to the first terminal of the heating elements 13. A connecting assembly 90 is installed in the center of the lower body portion 66 to connect to the electrode 23 to provide the second terminal of the electric power supply to the second terminal of the heating elements 13.

In certain embodiments, the electronic cigarette has an e-liquid storage 70 to store e-liquid. The e-liquid storage 70 is defined inside of the middle body portion 60. The e-liquid in the e-liquid storage 70 is soaked into the e-liquid media 14 through e-liquid conduit opening 94 on both sides. When the user turn on the electric power supply, the heating wires of the heating elements 13 are energized and heat up the e-liquid soaked in the e-liquid media 14 to vaporize the e-liquid therein, and create e-liquid vapor. When the user sucks the mouthpiece 80, the vapor goes up through the vaporizing chamber to the mouthpiece 80 to reach the user. The e-liquid continues to come into the e-liquid media 14, and burned off by the heating elements 13, and the vaporizing process is repeated.

In certain embodiments, the heating elements 13 are arranged in the large flat surface, the heat exchange between the e-liquid soaked in the e-liquid media 14 and the heating wires are even, and the e-liquid is sufficiently vaporized to create unusually large amount of vapor. Therefore, the vaporizing process has very high efficiency. Only the e-liquid vapor reaches the user, and the residue of the e-liquid will remain at the bottom of the vaporizing chamber, and will not reach the user. In certain embodiments, the e-liquid media 14 are made of various fibers such as cotton, polypropylene fiber, terylene fiber, or nylon fiber.

In certain embodiments, in order to simulate the cigarette smoking, the outside shape of the electronic cigarette, the mouthpiece 80, the upper body portion 62, the middle body portion 60, the heating assembly holder 64, and the lower body portion 66 are all in round shapes.

In certain embodiments, the e-liquid conduit opening 94 allows e-liquid to directly soak the e-liquid media 14 such that the flow of the e-liquid from the e-liquid storage 70 to the heating elements 13 is smooth, that sufficient e-liquid is retained in the e-liquid media 14 for efficient vaporization, and that the e-liquid media 14 will not be too dry to create burning smell.

Referring now to FIGS. 12-16, in yet another aspect, the present invention relates to a third vaporizer heating assembly 300 for electronic cigarettes. In certain embodiments, the third vaporizer heating assembly 300 includes: (a) a first vaporizer shield 91 and a second vaporizer shield 91, (b) a first heating element 13 and a second heating element 13, (c) a first e-liquid medium 14 and a second e-liquid medium 14, (d) a first positioning block 95 and a second positioning block 95, and (e) a vaporizing chamber side cover 311.

In certain embodiments, the first vaporizer shield 91 is positioned on a first side, and the second vaporizer shield 91 is positioned on an opposite, second side, of a circular heating element base 211. Each of the first and the second vaporizer shields 91 defines an e-liquid opening 911. Each of the first and the second heating elements 13 has a first terminal and a second terminal.

In certain embodiments, the first e-liquid medium 14 is vertically positioned inside of the first vaporizer shield 91, and the second e-liquid medium 14 is vertically positioned inside of the second vaporizer shield 91. Each of the first and the second e-liquid media 14 has an exterior portion 99, an interior portion 98, and a medium layer 96. The first heating element 13 is positioned inside of the medium layer 96 between the exterior portion 99 and the interior portion 98 of the first e-liquid medium 14, the second heating element 13 is positioned inside of the medium layer 96 between the exterior portion 99 and the interior portion 98 of the second e-liquid medium 14. Each of the first and the second e-liquid media 14 defines an air vent 97 to provide vaporized e-liquid from the air vent 97 to a user.

In certain embodiments, the first positioning block 95, and the second positioning block 95 are vertically positioned between the first and the second e-liquid media 14 to form a vaporizing chamber in the space between the two e-liquid media 14, and the two positioning blocks 95. The vaporizing chamber has an open upper end, and an open lower end. The vaporizing chamber side cover 311 is used to surround the vaporizer shields 91, the e-liquid media 14, and the positioning blocks 95. The vaporizing chamber side cover 311 defines a first e-liquid conduit opening 112 on a first side, adjacent to and in communication with the first e-liquid opening 911 of the first vaporizer shield 91, a second e-liquid conduit opening 112 on an opposite side, adjacent to and in communication with the second e-liquid opening 911 of the second vaporizer shield 91. A plurality of e-liquid medium side openings 113 are defined on the adjacent sides of the vaporizing chamber side cover 311 to expose e-liquid to the sides of the first and the second e-liquid media 14.

In certain embodiments, the third vaporizer heating assembly 300 also has an electrical conductor assembly 20. The electrical conductor assembly 20 has: (a) an electric connector base 21, (b) an electrode 23, and (c) an insulation cover 22. The electric connector base 21 is attached to the open lower end of the vaporizing chamber and the electric connector base 21 is used to connect an electric power supply to the third vaporizer heating assembly 300. The electric connector base 21 has an outer thread 212 configured to electrically connect a first terminal of the electric power supply to the first terminal of the heating elements 13.

In certain embodiments, the electrode 23 is used to electrically connect a second terminal of the electric power supply to the second terminal of the heating elements 13. The insulation cover 22 is positioned between the electric connector base 21 and the electrode 23 to provide insulation between the first and the second terminals of the electric power supply.

In certain embodiments, the heating element 13 has a heating wire. The heating wire has the first terminal to be connected to the first terminal of the electric power supply, and the second terminal to be connected to the second terminal of the electric power supply. The heating wire of the heating element 13 is wound to form a flat surface as shown in FIGS. 4-7. The flat surface may be in one of following shapes: (a) a spiral shape, (b) a parabolic spiral shape, (c) a rectangle shape, (d) a square shape, (e) a round shape, and (f) an oval shape.

In certain embodiments, the third vaporizer heating assembly 300 also includes: (a) a vapor tube 30 for providing vapor to the user, and (b) a vaporizing chamber top cover 114 coupled to the vapor tube 30 to guide the vapor to the user through the vapor tube 30. The vaporizing chamber top cover 114 is positioned on the upper end of the vaporizing chamber, and the vapor tube 30 is positioned on top of the vaporizing chamber top cover 114. A sealing cushion 50 may be used for sealing the vaporized e-liquid from escaping from the e-cigarette body to be installed outside of the third vaporizer heating assembly 300.

In certain embodiments, the present invention also relates to an electronic cigarette that includes the third vaporizer heating assembly 300. The electronic cigarette has: (a) a mouthpiece 80, (b) an upper body portion 62, (c) a middle body portion 60, (d) a heating assembly holder 64, and (e) a lower body portion 66. The upper body portion 62, the middle body portion 60, the heating assembly holder 64, and the lower body portion 66 are all cylindrical. A center air passage is defined through the mouthpiece 80, the upper body portion 62, the middle body portion 60, the heating assembly holder 64, and the lower body portion 66. The mouthpiece 80 is insertably installed in a top end of the upper body portion 62 with a sealing ring 82 to prevent the air vapor to escape. The upper body portion 62 is insertedly installed on a top end of the middle body portion 60, and the middle body portion 60 is insertably installed on a top end of the heating assembly holder 64.

The heating assembly 300 is installed inside of the heating assembly holder 64. The lower body portion 66 is installed on the electric connector base 21 through the outer thread 212 configured to electrically connect a first terminal of the electric power supply to the first terminal of the heating elements 13. A connecting assembly 90 is installed in the center of the lower body portion 66 to connect to the electrode 23 to provide the second terminal of the electric power supply to the second terminal of the heating elements 13.

In certain embodiments, the electronic cigarette has an e-liquid storage 70 to store e-liquid. The e-liquid storage 70 is defined inside of the middle body portion 60. The e-liquid in the e-liquid storage 70 is soaked into the e-liquid media 14 through e-liquid conduit opening 94 on both sides. When the user turn on the electric power supply, the heating wires of the heating elements 13 are energized and heat up the e-liquid soaked in the e-liquid media 14 to vaporize the e-liquid therein, and create e-liquid vapor. When the user sucks the mouthpiece 80, the vapor goes up through the vaporizing chamber to the mouthpiece 80 to reach the user. The e-liquid continues to come into the e-liquid media 14, and burned off by the heating elements 13, and the vaporizing process is repeated.

In certain embodiments, the heating elements 13 are arranged in the large flat surface, the heat exchange between the e-liquid soaked in the e-liquid media 14 and the heating wires are even, and the e-liquid is sufficiently vaporized to create unusually large amount of vapor. Therefore, the vaporizing process has very high efficiency. Only the e-liquid vapor reaches the user, and the residue of the e-liquid will remain at the bottom of the vaporizing chamber, and will not reach the user. In certain embodiments, the e-liquid media 14 are made of various fibers such as cotton, polypropylene fiber, terylene fiber, or nylon fiber.

In certain embodiments, in order to simulate the cigarette smoking, the outside shape of the electronic cigarette, the mouthpiece 80, the upper body portion 62, the middle body portion 60, the heating assembly holder 64, and the lower body portion 66 are all in round shapes.

In certain embodiments, the e-liquid conduit opening 94 allows e-liquid to directly soak the e-liquid media 14 such that the flow of the e-liquid from the e-liquid storage 70 to the heating elements 13 is smooth, that sufficient e-liquid is retained in the e-liquid media 14 for efficient vaporization, and that the e-liquid media 14 will not be too dry to create burning smell.

Referring now to FIGS. 17-20, in a further aspect, the present invention relates to a fourth vaporizer heating assembly 400 for electronic cigarettes. In certain embodiments, the fourth vaporizer heating assembly 400 has: (a) a first vaporizer shield 91 and a second vaporizer shield 91, (b) a first heating element 13 and a second heating element 13, (c) a first e-liquid medium 14 and a second e-liquid medium 14, (d) a first positioning block 95 and a second positioning block 95, and (e) a vaporizing chamber side cover 411.

In certain embodiments, the first vaporizer shield 91 is positioned on a first side, and the second vaporizer shield 91 is positioned on an opposite, second side of a circular heating element base 211. Each of the first and the second vaporizer shields 91 has a straight interior surface 912, and an arc exterior surface 913, and defines an e-liquid opening 911 between the straight interior surface 912 and the arc exterior surface 913. Each of the first heating element 13 and the second heating element 13 has a first terminal and a second terminal.

In certain embodiments, the first e-liquid medium 14 is vertically positioned inside of the first vaporizer shield 91, and the second e-liquid medium 14 is vertically positioned inside of the second vaporizer shield 91. Each of the first and the second e-liquid media 14 has an exterior portion 99, an interior portion 98, and a medium layer 96. The first heating element 13 is positioned inside of the medium layer 96 between the exterior portion 99 and the interior portion 98 of the first e-liquid medium 14. The second heating element 13 is positioned inside of the medium layer 96 between the exterior portion 99 and the interior portion 98 of the second e-liquid medium 14. Each of the first and the second e-liquid media 14 defines an air vent 97 on the interior portion 98 to provide vaporized e-liquid to a user.

In certain embodiments, the first positioning block 95 and the second positioning block 95 are vertically positioned between the first and the second e-liquid media 14 to form a vaporizing chamber. The vaporizing chamber has an open upper end, and an open lower end. The cylindrical vaporizing chamber side cover 411 is configured to surround the vaporizer shields 91, the e-liquid media 14, and the positioning blocks 95. The vaporizing chamber side cover 411 defines a first e-liquid conduit opening 112 adjacent to and in communication with the first e-liquid opening 911 of the first vaporizer shield 91, a second e-liquid conduit opening 112 adjacent to and in communication with the second e-liquid opening 911 of the second vaporizer shield 91, and a plurality of e-liquid medium side openings 113 to expose e-liquid to the side of the first and the second e-liquid media 14.

In certain embodiments, the fourth vaporizer heating assembly 400 also has an electrical conductor assembly 20. The electrical conductor assembly 20 has: (a) an electric connector base 21, (b) an electrode 23, and (c) an insulation cover 22. The electric connector base 21 is attached to the open lower end of the vaporizing chamber and is used for connecting an electric power supply to the fourth vaporizer heating assembly 400. The electric connector base 21 has an outer thread 212 configured to electrically connect a first terminal of the electric power supply to the first terminal of the heating elements 13. The electrode 23 is configured to electrically connect a second terminal of the electric power supply to the second terminal of the heating elements 13. The insulation cover 22 is positioned between the electric connector base 21 and the electrode 23 to provide insulation between the first and the second terminals of the electric power supply.

In certain embodiments, the heating element 13 has a heating wire. The heating wire has the first terminal to be connected to the first terminal of the electric power supply, and the second terminal to be connected to the second terminal of the electric power supply. The heating wire of the heating element 13 is wound to form a flat surface as shown in FIGS. 4-7. The flat surface may be in one of following shapes: (a) a spiral shape, (b) a parabolic spiral shape, (c) a rectangle shape, (d) a square shape, (e) a round shape, and (f) an oval shape.

In certain embodiments, the fourth vaporizer heating assembly 400 also has: (a) a vapor tube 30, and (b) a round vaporizing chamber top cover 114. The vapor tube 30 is used to provide vapor to the user. The round vaporizing chamber top cover 114 is attached to the vapor tube 30 to guide the vapor to the user through the vapor tube 30. The round vaporizing chamber top cover 114 is positioned on the upper end of the vaporizing chamber, and the vapor tube 30 is positioned on top of the round vaporizing chamber top cover 114.

In certain embodiments, the present invention also relates to an electronic cigarette that includes the fourth vaporizer heating assembly 400. The electronic cigarette has: (a) a mouthpiece 80, (b) an upper body portion 62, (c) a middle body portion 60, (d) a heating assembly holder 64, and (e) a lower body portion 66. The upper body portion 62, the middle body portion 60, the heating assembly holder 64, and the lower body portion 66 are all cylindrical. A center air passage is defined through the mouthpiece 80, the upper body portion 62, the middle body portion 60, the heating assembly holder 64, and the lower body portion 66. The mouthpiece 80 is insertably installed in a top end of the upper body portion 62 with a sealing ring 82 to prevent the air vapor to escape. The upper body portion 62 is insertedly installed on a top end of the middle body portion 60, and the middle body portion 60 is insertably installed on a top end of the heating assembly holder 64. The heating assembly 300 is installed inside of the heating assembly holder 64. The lower body portion 66 is installed on the electric connector base 21 through the outer thread 212 configured to electrically connect a first terminal of the electric power supply to the first terminal of the heating elements 13. A connecting assembly 90 is installed in the center of the lower body portion 66 to connect to the electrode 23 to provide the second terminal of the electric power supply to the second terminal of the heating elements 13.

In certain embodiments, the electronic cigarette has an e-liquid storage 70 to store e-liquid. The e-liquid storage 70 is defined inside of the middle body portion 60. The e-liquid in the e-liquid storage 70 is soaked into the e-liquid media 14 through e-liquid conduit opening 94 on both sides. When the user turn on the electric power supply, the heating wires of the heating elements 13 are energized and heat up the e-liquid soaked in the e-liquid media 14 to vaporize the e-liquid therein, and create e-liquid vapor. When the user sucks the mouthpiece 80, the vapor goes up through the vaporizing chamber to the mouthpiece 80 to reach the user. The e-liquid continues to come into the e-liquid media 14, and burned off by the heating elements 13, and the vaporizing process is repeated.

In certain embodiments, the heating elements 13 are arranged in the large flat surface, the heat exchange between the e-liquid soaked in the e-liquid media 14 and the heating wires are even, and the e-liquid is sufficiently vaporized to create unusually large amount of vapor. Therefore, the vaporizing process has very high efficiency. Only the e-liquid vapor reaches the user, and the residue of the e-liquid will remain at the bottom of the vaporizing chamber, and will not reach the user. In certain embodiments, the e-liquid media 14 are made of various fibers such as cotton, polypropylene fiber, terylene fiber, or nylon fiber.

In certain embodiments, in order to simulate the cigarette smoking, the outside shape of the electronic cigarette, the mouthpiece 80, the upper body portion 62, the middle body portion 60, the heating assembly holder 64, and the lower body portion 66 are all in round shapes.

In certain embodiments, the e-liquid conduit opening 94 allows e-liquid to directly soak the e-liquid media 14 such that the flow of the e-liquid from the e-liquid storage 70 to the heating elements 13 is smooth, that sufficient e-liquid is retained in the e-liquid media 14 for efficient vaporization, and that the e-liquid media 14 will not be too dry to create burning smell.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims, the foregoing description and the exemplary embodiments described therein, and accompanying drawings.

What is claimed is:

1. A first vaporizer heating assembly for electronic cigarettes, comprising:

a cylindrical heating assembly cover positioned on a circular heating element base, wherein the cylindrical heating assembly cover has an open upper end defining a mounting hole, and an opposite, open lower end, and two e-liquid conduit openings are defined on a first side of middle section of the cylindrical heating assembly cover, and an opposite, second side of the middle section of the cylindrical heating assembly cover;

a circular heating element mounting base detachably positioned inside of the cylindrical heating assembly cover, wherein the circular heating element mounting base has two upright arches with a plurality of separator plates connecting the two upright arches and defining a mounting base air vent inside of the plurality of separator plates, and a plurality of mounting portions outside of the plurality of separator plates, and each of the plurality of separator plates defines a heating element opening;

a plurality of heating elements, having one positioned inside of the heating element opening of each of the plurality of separator plates, respectively, wherein each of the plurality of heating elements comprises a first terminal, and a second terminal;

a plurality of e-liquid media, each of the plurality of e-liquid media is detachably positioned outside of each of the plurality of heating elements, in each of the plurality of mounting portions, respectively; and a plurality of e-liquid medium arches, each of the plurality of e-liquid medium arches is detachably positioned outside each of the plurality of e-liquid media, respectively, wherein each of the plurality of e-liquid medium arches defines an e-liquid opening in communication with the e-liquid conduit openings to allow e-liquid to flow through the e-liquid conduit openings to reach the plurality of e-liquid media.

2. A second vaporizer heating assembly for electronic cigarettes, comprising:

a first "U" shaped vaporizer shield on a first side, and a second "U" shaped vaporizer shield on an opposite, second side, of a circular heating element base and form a substantially square vaporizing chamber having an open upper end, and an open lower end, and defining two gaps, one on each side, between the first and the second vaporizer shields, and each of the first and the second vaporizer shields defines an e-liquid conduit opening;

a plurality of e-liquid media, wherein each of the plurality of e-liquid media is detachably positioned inside of the first and the second vaporizer shields and is in communication with e-liquid through the e-liquid conduit opening, respectively;

a plurality of heating elements, wherein each of the plurality of heating elements is detachably positioned inside of the plurality of e-liquid media, respectively, and each of the plurality of heating elements comprises a first terminal, and a second terminal; and a plurality of sealing blocks, each of the plurality of sealing blocks is detachably positioned in one of the two gaps, respectively, to form the vaporizing chamber between the plurality of heating elements.

3. The first vaporizer heating assembly of claim 2, wherein each of the plurality of heating elements comprises a heating wire having the first terminal for electrically connecting to the first terminal of the electric power supply, and the second terminal for electrically connecting to the second terminal of the electric power supply, and forming a flat surface in a shape comprising:

a spiral;

a parabolic spiral;

a rectangle;

a round;

an oval; and a square.

4. The first vaporizer heating assembly of claim 1, further comprising:

a vapor tube adapted for providing vapor to a user; and a pressure sealing ring to prevent vapor from escaping from the vapor tube, wherein the pressure sealing ring is positioned on the upper end of the cylindrical heating assembly cover, and the vapor tube is positioned on top of the pressure sealing ring.

5. An electronic cigarette comprising the first vaporizer heating assembly of claim 1.

6. A second vaporizer heating assembly for electronic cigarettes, comprising:

a first "U" shaped vaporizer shield on a first side, and a second "U" shaped vaporizer shield on an opposite, second side, of a circular heating element base and form a substantially square vaporizing chamber having an open upper end, and an open lower end, and defining two gaps, one on each side, between the first and the second vaporizer shields, and each of the first and the second vaporizer shields defines an e-liquid conduit opening;

a plurality of e-liquid media, wherein each of the plurality of e-liquid media is detachably positioned inside of the first and the second vaporizer shields and is in communication with e-liquid through the e-liquid conduit opening, respectively;

a plurality of heating elements, wherein each of the plurality of heating elements is detachably positioned inside of the plurality of e-liquid media, respectively, and each of the plurality of heating elements comprises a first terminal, and a second terminal; and a plurality of sealing blocks, each of the plurality of sealing blocks is detachably positioned in each of the two gaps, respectively, to form the vaporizing chamber between the plurality of heating elements.

7. The second vaporizer heating assembly of claim 6, further comprising an electric connector assembly, wherein the electric connector assembly comprises:

an electric connector base attached to the open lower end of the vaporizing chamber and adapted for connecting an electric power supply to the second vaporizer heating assembly, wherein the electric connector base comprises an outer thread configured to electrically connect a first terminal of the electric power supply to the first terminal of the heating elements;

an electrode configured to electrically connect a second terminal of the electric power supply to the second terminal of the heating elements; and an insulation cover positioned between the electric connector base and the electrode to provide insulation between the first and the second terminals of the electric power supply.

8. The second vaporizer heating assembly of claim 7, wherein each of the plurality of heating elements comprises a heating wire having the first terminal for electrically connecting to the first terminal of the electric power supply, and the second terminal for electrically connecting to the second terminal of the electric power supply, and forming a flat surface in a shape comprising:

a spiral;

a parabolic spiral;

a rectangle;

a round;

an oval; and a square.

9. The second vaporizer heating assembly of claim 6, further comprising:

a vapor tube adapted for providing vapor to a user; and an upper vaporizing chamber cover to prevent vapor from escaping from the vapor tube, wherein the upper vaporizing chamber cover is positioned on an upper end of the vaporizing chamber, and the vapor tube is positioned on top of the upper vaporizing chamber cover.

10. An electronic cigarette comprising the second vaporizer heating assembly of claim 6.

11. A third vaporizer heating assembly for electronic cigarettes, comprising:

a first vaporizer shield on a first side, and a second vaporizer shield on an opposite, second side, of a circular heating element base, and each of the first and the second vaporizer shields defines an e-liquid opening;

a first heating element, and a second heating element, wherein each of the first and second heating elements has a first terminal and a second terminal;

a first e-liquid medium vertically positioned inside of the first vaporizer shield, and a second e-liquid medium vertically positioned inside of the second vaporizer shield, wherein each of the first and the second e-liquid media has an exterior portion, an interior portion, and a medium layer, the first heating element is positioned inside of the medium layer between the exterior portion and the interior portion of the first e-liquid medium, the second heating element is positioned inside of the medium layer between the exterior portion and the interior portion of the second e-liquid medium, and each of the first and the second e-liquid media defines an air vent on the interior portion to provide vaporized e-liquid to a user;

a first positioning block, and a second positioning block vertically positioned between the first and the second e-liquid media to form a vaporizing chamber having an open upper end, and an open lower end; and a vaporizing chamber side cover configured to surround the vaporizer shields, the e-liquid media, and the positioning blocks, wherein the vaporizing chamber side cover defines a first e-liquid conduit opening on a first side, adjacent to and in communication with the first e-liquid opening of the first vaporizer shield, a second e-liquid conduit opening on an opposite, second side, adjacent to and in communication with the second e-liquid opening of the second vaporizer shield, and a plurality of e-liquid medium side openings on the adjacent sides of the vaporizing chamber side cover to expose e-liquid to the side of the first and the second e-liquid media.

12. The third vaporizer heating assembly of claim 11, further comprising an electric connector assembly, wherein the electric connector assembly comprises:

an electric connector base attached to the open lower end of the vaporizing chamber and adapted for connecting an electric power supply to the third vaporizer heating assembly, wherein the electric connector base comprises an outer thread configured to electrically connect a first terminal of the electric power supply to the first terminal of the heating elements;

an electrode configured to electrically connect a second terminal of the electric power supply to the second terminal of the heating elements; and an insulation cover positioned between the electric connector base and the electrode to provide insulation between the first and the second terminals of the electric power supply.

13. The third vaporizer heating assembly of claim 12, wherein each of the plurality of heating elements comprises a heating wire having the first terminal for electrically connecting to the first terminal of the electric power supply, and the second terminal for electrically connecting to the second terminal of the electric power supply, and forming a flat surface in a shape comprising:

a spiral;

a parabolic spiral;

a rectangle;

a round;

an oval; and a square.

14. The third vaporizer heating assembly of claim 11, further comprising:

a vapor tube adapted for providing vapor to the user; and a vaporizing chamber top cover coupled to the vapor tube to guide the vapor to the user through the vapor tube, wherein the vaporizing chamber top cover is positioned on the upper end of the vaporizing chamber, and the vapor tube is positioned on top of the vaporizing chamber top cover.

15. An electronic cigarette comprising the third vaporizer heating assembly of claim 11.

16. A fourth vaporizer heating assembly for electronic cigarettes, comprising:

a first vaporizer shield on a first side, and a second vaporizer shield on an opposite, second side, of a circular heating element base, and each of the first and the second vaporizer shields comprises a straight interior surface, and an arc exterior surface, and defines an e-liquid opening between the straight interior surface and the arc exterior surface;

a first heating element, and a second heating element, wherein each of the first and second heating elements has a first terminal and a second terminal;

a first e-liquid medium vertically positioned inside of the first vaporizer shield, and a second e-liquid medium vertically positioned inside of the second vaporizer shield, wherein each of the first and the second e-liquid media has an exterior portion, an interior portion, and a medium layer, the first heating element is positioned inside of the medium layer between the exterior portion and the interior portion of the first e-liquid medium, the second heating element is positioned inside of the medium layer between the exterior portion and the interior portion of the second e-liquid medium, and each of the first and the second e-liquid media defines an air vent on the interior portion to provide vaporized e-liquid to a user;

a first positioning block, and a second positioning block vertically positioned between the first and the second e-liquid media to form a vaporizing chamber having an open upper end, and an open lower end; and a cylindrical vaporizing chamber side cover configured to surround the vaporizer shields, the e-liquid media, and the positioning blocks, wherein the cylindrical vaporizing chamber side cover defines a first e-liquid conduit opening adjacent to and in communication with a first e-liquid opening of the first vaporizer shield, a second e-liquid conduit opening adjacent to and in communication with a second e-liquid opening of the second vaporizer shield, and a plurality of e-liquid medium side openings to expose e-liquid to the side of the first and the second e-liquid media.

17. The fourth vaporizer heating assembly of claim 16, further comprising an electric connector assembly, wherein the electric connector assembly comprises:

an electric connector base attached to the open lower end of the vaporizing chamber and adapted for connecting an electric power supply to the fourth vaporizer heating assembly, wherein the electric connector base comprises an outer thread configured to electrically connect a first terminal of the electric power supply to the first terminal of the heating elements;

an electrode configured to electrically connect a second terminal of the electric power supply to the second terminal of the heating elements; and an insulation cover positioned between the electric connector base and the electrode to provide insulation between the first and the second terminals of the electric power supply.

18. The fourth vaporizer heating assembly of claim 17, wherein each of the plurality of heating elements comprises a heating wire having the first terminal for electrically connecting to the first terminal of the electric power supply, and the second terminal for electrically connecting to the second terminal of the electric power supply, and forming a flat surface in a shape comprising:

a spiral;

a parabolic spiral;

a rectangle;

a round;

an oval; and a square.

19. The fourth vaporizer heating assembly of claim 16, further comprising:

a vapor tube adapted for providing vapor to the user; and a round vaporizing chamber top cover coupled to the vapor tube to guide the vapor to the user through the vapor tube, wherein the round vaporizing chamber top cover is positioned on the upper end of the vaporizing chamber, and the vapor tube is positioned on top of the round vaporizing chamber top cover.

20. An electronic cigarette comprising the fourth vaporizer heating assembly of claim 16.

* * * * *